US007950261B2

(12) United States Patent
Sasaki et al.

(10) Patent No.: US 7,950,261 B2
(45) Date of Patent: May 31, 2011

(54) METHOD AND APPARATUS FOR PRESS FORMING SHEET MATERIAL

(75) Inventors: Jiro Sasaki, Shizuoka (JP); Masahiro Morishita, Shizuoka (JP)

(73) Assignee: Yutaka Giken Co., Ltd., Shizuoka (JP)

( * ) Notice: Subject to any disclaimer, the term of this patent is extended or adjusted under 35 U.S.C. 154(b) by 1018 days.

(21) Appl. No.: 10/570,388

(22) PCT Filed: Sep. 6, 2004

(86) PCT No.: PCT/JP2004/012944
§ 371 (c)(1),
(2), (4) Date: Nov. 15, 2006

(87) PCT Pub. No.: WO2005/023449
PCT Pub. Date: Mar. 17, 2005

(65) Prior Publication Data

US 2007/0164470 A1 Jul. 19, 2007

(30) Foreign Application Priority Data

Sep. 5, 2003 (JP) ..... 2003-313848

(51) Int. Cl.
*B21D 22/00* (2006.01)

(52) U.S. Cl. ..... 72/348; 72/333; 72/399

(58) Field of Classification Search ..... 72/69, 325, 72/348, 327, 333, 347, 356, 360, 399, 400, 72/401, 403
See application file for complete search history.

(56) References Cited

U.S. PATENT DOCUMENTS

| | | | | |
|---|---|---|---|---|
| 1,804,607 | A * | 5/1931 | Groehn | 72/341 |
| 1,812,046 | A * | 6/1931 | Groehn | 72/401 |
| 3,124,091 | A * | 3/1964 | Williamson | 72/400 |
| 3,748,791 | A * | 7/1973 | Foster | 451/54 |
| 4,489,584 | A * | 12/1984 | Gall et al. | 72/327 |
| 5,297,416 | A * | 3/1994 | Alhamad et al. | 72/379.4 |
| 5,761,949 | A * | 6/1998 | Dalessandro et al. | 72/325 |
| 6,082,166 | A * | 7/2000 | Marin | 72/348 |
| 6,167,742 | B1 * | 1/2001 | Marin | 72/351 |
| 6,336,780 | B1 * | 1/2002 | Chasteen | 413/8 |
| 2004/0020261 | A1 | 2/2004 | Tokuda | |

FOREIGN PATENT DOCUMENTS

| | | |
|---|---|---|
| JP | 77551 | 6/1988 |
| JP | 2-1515 | 1/1990 |
| JP | 03-258423 | 11/1991 |
| JP | 06-269870 | 9/1994 |
| JP | 06-328157 | 11/1994 |
| JP | 07-009045 | 1/1995 |
| JP | 08-117880 | 5/1996 |

(Continued)

*Primary Examiner* — Edward Tolan
(74) *Attorney, Agent, or Firm* — Arent Fox LLP

(57) ABSTRACT

A press forming apparatus comprises an upper die provided with an upper drawing die, a punch, an upper movable blank holder, and a trimming member and a lower die provided with a lower drawing die, a die, an outer periphery drawing die, and a lower movable blank holder. The upper die is lowered with respect to the lower dye, and the outer periphery portion of a blank is held by the trimming member and the upper blank holder. The central portion of the blank is drawn by the upper and lower drawing dies. The outer periphery portion of the blank is trimmed by the trimming member and the outer periphery drawing die, and drawing of the outer periphery portion of the blank is started by the upper drawing die and the outer periphery drawing die.

9 Claims, 17 Drawing Sheets

FOREIGN PATENT DOCUMENTS

| | | | |
|---|---|---|---|
| JP | 10-296346 | | 11/1998 |
| JP | 11-019728 | | 1/1999 |
| JP | 2003-103313 | | 4/2003 |
| JP | 2003103313 | A * | 4/2003 |
| JP | 2003-126935 | | 5/2003 |
| JP | 2006055907 | | 3/2006 |

* cited by examiner

METHOD AND APPARATUS FOR PRESS FORMING SHEET MATERIAL

CROSS-REFERENCE TO RELATED APPLICATION

This application is a National Stage entry of International Application No. PCT/JP2004/012944, filed Sep. 6, 2004, the entire specification claims and drawings of which are incorporated herewith by reference.

TECHNICAL FIELD

The present invention relates to a method and apparatus for press forming a sheet material, in which, other secondary working operations can be performed while shape forming operation for a sheet material is performed in one cycle of pressing operation.

BACKGROUND ART

A component constituting an automotive silencer, for example, an end plate is manufactured by press forming of a sheet material. The conventional typical method consists of four processes: the outer periphery portion of a sheet material is cut (trimmed) to form a predetermined blank, a predetermined formed surface in the central portion of the blank is drawn, a predetermined non-formed surface in the central portion of the blank is pierced to form a pierced hole (pipe mounting hole), and finally burring around the pierced hole in the blank and bending of the outermost portion of the blank are performed, thereby obtaining an end plate product.

As a press forming method for a sheet material, a press forming method in which the drawing and the secondary working of a sheet material are performed by one cycle of pressing operation has been known (for example, refer to FIG. 1 of Patent Document 1).

In the forming method described in this publication, an upper die to which a punch is installed via an elastic means is lowered with respect to a lower die on which a blank is set, by which a sheet material is drawn by the upper and lower dies. Then, an upper cutting blade mounted on the upper die is projected downward by the lowering of the upper die, whereby the outer periphery portion of the sheet material is trimmed or trimmed and downwardly bent by the upper cutting blade and a lower cutting blade mounted on the lower die. Next, the lower cutting blade is projected upward by the lowering of the upper die, whereby the outer periphery portion of the sheet material is upwardly bent by the upper cutting blade and the lower cutting blade.

With this forming method, three processes of drawing, and outer periphery trimming and outer periphery bending, which are secondary working operations, can be performed by one pressing operation, but further secondary working operations cannot be performed simultaneously by this pressing operation. Therefore, for example, in the case where the above-mentioned silencer end plate is manufactured, piercing and burring must be performed separately, so that the shortening of pressing operation time is limited. Also, an independent die for piercing operation etc. is required. Therefore, the reduction in die cost is not so big.

Also, since the outer periphery trimming operation and the outer periphery bending operation are performed in succession after the drawing operation has been finished, this method has a drawback in that the working stroke is long. Furthermore, since the cutting blades for cutting the outer periphery are not fixed to the upper and lower die set and are movable, there arises a problem in that a backup mechanism (guide mechanism) is needed.

Patent Document 1: Japanese Patent Laid-Open No. H08-290219

DISCLOSURE OF INVENTION

Problems to be Solved by the Invention

Accordingly, an object of the present invention is to provide a method and apparatus for press forming a sheet material, in which a plurality of secondary working operations, such as trimming, piercing, burring, bending, and coining can be performed while a shape forming operation is performed for a sheet material, whereby a component, such as an end plate of a silencer can be obtained by on cycle of pressing operation for the sheet material.

Means for Solving the Problems

To achieve the above object, the current invention provides a press forming method for a sheet material, in which an upper die provided with one of dies for drawing a sheet material and one of a plurality of secondary working members separate from the dies, which perform secondary working, such as trimming, piercing, burring, bending, or coining of the sheet material, is lowered with respect to a lower die provided with the other of the dies and the other of the secondary working members, wherein a plurality of secondary working operations, such as trimming, piercing, burring, bending, or coining are performed in the same process while shape forming is performed by drawing operation for the sheet material.

The invention provides a press forming method for a sheet material in which an upper die provided with an upper drawing die, a punch, and a trimming member also used as a blank holder and a bending die is lowered with respect to a lower die provided with a lower drawing die, a die, an outer periphery drawing die also used as a trimming member and a bending die, and a blank holder, wherein the outer periphery portion of a blank placed on the blank holder is held by the blank holder and the trimming member, successively, the central portion of the blank is drawn by the lower drawing die and the upper drawing die by moving the lower drawing die upward under pressure, successively, the outer periphery portion of the blank is trimmed by the trimming member and the outer periphery drawing die, successively, overall forming by drawing of the outer periphery portion of the blank performed by the upper drawing die and the outer periphery drawing die is started, and at the same time, piercing of the blank is performed by the punch and the die, and burring around an opened pierced hole is started, successively, bending of the outermost periphery portion of the blank is started by the trimming member and the outer periphery drawing die, and as the upper die reaches the bottom dead center, the overall forming, burring, and bending of the outermost periphery portion of the blank are completed.

The invention provides a press forming method for a sheet material in which an upper die provided with an upper drawing die, a punch, a blank holder, and a trimming member is lowered with respect to a lower die provided with a lower drawing die, a die, and an outer periphery drawing die also used as a blank holder and a trimming member, wherein the outer periphery portion of a blank placed on the outer periphery drawing die is held by the outer periphery drawing die and the blank holder, successively, the central portion of the blank is pressed between the upper drawing die and the lower drawing die, and the outer periphery portion of the blank is trimmed by the trimming member and the outer periphery drawing die, successively, drawing of the outer periphery portion of the blank is started by the upper drawing die and the outer periphery drawing die, successively, the blank is pierced by the punch and the die, and burring around an opened pierced hole is started, and as the upper die reaches the bottom dead center, the drawing of the outer periphery portion of the blank and the burring are completed.

The invention provides a press forming method for a sheet material in which an upper die provided with an upper drawing die, a pierced hole periphery die having a concave portion for coining, a punch, and an upper blank holder is lowered with respect to a lower die provided with a lower drawing die having a punch housing hole, a coining punch, a lower blank holder, and a trimming member also used as a blank holder, wherein the outer periphery portion of a blank placed on the trimming member is held by the trimming member and the upper blank holder, successively, the outer periphery portion of the blank is trimmed by the upper drawing die and the lower blank holder, successively, overall forming by drawing of the blank is started in cooperation by the upper drawing die and the lower drawing die, successively, the pierced hole periphery portion of the blank is drawn in cooperation by the pierced hole periphery die and the lower drawing die by moving the pierced hole periphery die downward under pressure, successively, the blank is pierced by the punch and the punch housing hole, successively, coining of the blank is started by the coining punch and the concave portion for coining, and as the upper die reaches the bottom dead center, the overall forming and coining of the blank are completed.

The invention provides a press forming apparatus for a sheet material including upper and lower dies wherein the upper die is lowered with respect to the lower die, in which the upper die is provided with one of dies for drawing a sheet material and one of a plurality of secondary working members separate from the dies, which perform secondary working, such as trimming, piercing, burring, bending, or coining of the sheet material, and the lower die is provided with the other of the dies and the other of the secondary working members, and shape forming by drawing operation for the sheet material and a plurality of shape forming operations, such as trimming, piercing, burring, bending, or coining can be performed by one cycle of pressing operation.

The invention provides a press forming apparatus for a sheet material in which the upper die comprises an upper drawing die fixed to an upper die body; a punch which passes through the upper drawing die and is fixed to the upper die body; an upper movable blank holder which is arranged at the outer periphery of the upper drawing die so as to be movable in the vertical direction and is urged downward with respect to the upper die body; and a trimming member which is arranged at the outer periphery of the upper movable blank holder and is fixed to the upper die body, and is also used as a blank holder and a bending die, and the lower die comprises a lower drawing die which is arranged in a lower die body so as to be movable in the vertical direction and is urged upward with respect to the lower die body and be capable of applying pressure in the vertical direction, and draws the central portion of a blank in cooperation with the upper drawing die; a die which passes through the lower drawing die and is fixed to the lower die body, and performs piercing of the blank in cooperation with the punch and performs burring around an opened pierced hole; wherein an outer periphery drawing die, also used as a trimming member and a bending die, which is arranged at the outer periphery of the lower drawing die and is fixed to the lower die body, performs overall forming by drawing of the outer periphery portion of the blank in cooperation with the upper drawing die, and trims the outer periphery portion of the blank in cooperation with the trimming member and further bends the outermost periphery portion of the blank in cooperation with the upper movable blank holders and a lower movable blank holder which is arranged at the outer periphery of the outer periphery drawing die so as to be movable in the vertical direction and is urged upward with respect to the lower die body, on which the blank is placed, and which holds the outer periphery portion of the blank in cooperation with the trimming members.

The invention provides a press forming apparatus for a sheet material in which the upper die comprises an upper drawing die fixed to an upper die body; a punch which passes through the upper drawing die and is fixed to the upper die body; a movable blank holder which is arranged at the outer periphery of the upper drawing die so as to be movable in the vertical direction and is urged downward with respect to the upper die body; and a trimming member which is arranged at the outer periphery of the movable blank holder and is fixed to the upper die body, and the lower die comprises a lower drawing die which is arranged in a lower die body so as to be movable in the vertical direction and is urged upward with respect to the lower die body, and presses the central portion of a blank between the upper drawing die and the lower drawing die; a die which passes through the lower drawing die and is fixed to the lower die body, and performs piercing of the blank in cooperation with the punch and performs burring around an opened pierced hole; and an outer periphery drawing die, also used as a blank holder and a trimming member, which is arranged at the outer periphery of the lower drawing die and is fixed to the lower die body, holds the outer periphery portion of the blank between the movable blank holder and the outer periphery drawing die, and trims the outer periphery portion of the blank in cooperation with the trimming member and further draws the outermost periphery portion of the blank in cooperation with the upper drawing die.

The invention provides a press forming apparatus for a sheet material in which the upper die comprises an upper drawing die fixed to an upper die body; a pierced hole periphery die having a concave portion for coining, which passes through the upper drawing die and is arranged in the upper die body so as to be movable in the vertical direction and can be moved downward under pressure; a punch which passes through the pierced hole periphery die and is fixed to the upper die body; and an upper movable blank holder which is arranged at the outer periphery of the upper drawing die so as to be movable in the vertical direction and is urged downward with respect to the upper die body, the lower die comprises a lower drawing die which is arranged in a lower die body so as to be movable in the vertical direction and is urged upward with respect to the lower die body, and performs overall forming by drawing of the blank in cooperation with the upper drawing die and performs drawing of the periphery portion of the pierced hole of the blank in cooperation with the pierced hole periphery die; a punch housing hole formed in the lower drawing die to pierce the blank in cooperation with the punch; a coining punch which passes through the lower drawing die and is arranged in the lower die body so as to be movable in the vertical direction, and performs coining of the blank in cooperation with the concave portion for coining; a lower movable blank holder which is arranged at the outer periphery of the lower drawing die so as to be movable in the vertical direction and is urged downward with respect to the lower die body, and holds the outer periphery portion of the blank in cooperation with the upper drawing die; and a trimming member, also used as a blank holder, which is arranged at the outer periphery of the lower movable blank holder and is fixed to the lower die body, and presses the outer periphery of the blank between the upper movable blank holder and the trimming member and also trims the outer periphery of the blank in cooperation with the upper drawing die, wherein the lower die body is provided further with a coining punch driving mechanism comprised of a trapezoidal horizontally movable member which is supported so as to be movable in the horizontal direction, a receiving member which has an inclined surface abutting on an inclined surface at one end of the horizontally movable member and is moved downward by receiving a pressing force due to the lowering of the upper die, and a vertically movable member which has an inclined surface abutting on an inclined surface at the other end of the horizontally movable member and is moved upward by receiving a pressing force due to the horizontal movement of the horizontally movable member.

The invention provides a press forming apparatus for a sheet material in which the upper die body is comprised of a top plate and a holder arranged under the top plate, the upper drawing die is fixed to the holder, the pierced hole periphery die is installed to a connecting body capable of applying pressure in the downward direction, which passes through the upper drawing die and the holder and is hung from the holder, the punch passes through the pierced hole periphery die and the holder and is fixed to the top plate, the upper movable blank holder passes through the holder and is fixed to the top plate, the holder is urged downward by a spring member installed to the top plate, and the lower surface thereof is supported by the lower end of a retainer which passes through the holder and is installed to the top plate, when the upper die is lowered, the lowering of the holder is stopped by the resistance force at the time of trimming of the outer periphery portion of the blank and only the top plate is lowered until a pressurizing tool provided on the lower surface of the top plate abuts on the holder, and subsequently, after the pressurizing tool has abutted on the holder, the whole of the upper die has lowered to the bottom dead center, and the forming of the blank has been completed, when the upper die is raised, the rising of the holder is prevented from occurring until the lower end of the retainer abuts on the lower surface of the holder.

According to the present invention, a plurality of secondary working operations of two or more processes, such as trimming, piercing, burring, bending, or coining can be performed while shape forming by drawing of a sheet material (blank) is performed, so that a component, such as an end plate of a silencer can be obtained by one cycle of pressing operation of the sheet material. Also, since the working operations are finished by one cycle of pressing operation, the position accuracy of hole, coining, etc. with respect to the shape, the height accuracy etc. of burring, and the product accuracy are improved. Also, since some of the plurality of processes start at the same time, or during one process, other processes are started, the working stroke does not become long. Furthermore, since the trimming member for trimming the outer periphery portion of the sheet material is fixed to the upper die body or the lower die body, a backup mechanism (guide mechanism) or the like for the trimming member is not needed.

BEST MODE FOR CARRYING OUT THE INVENTION

Figure 1:
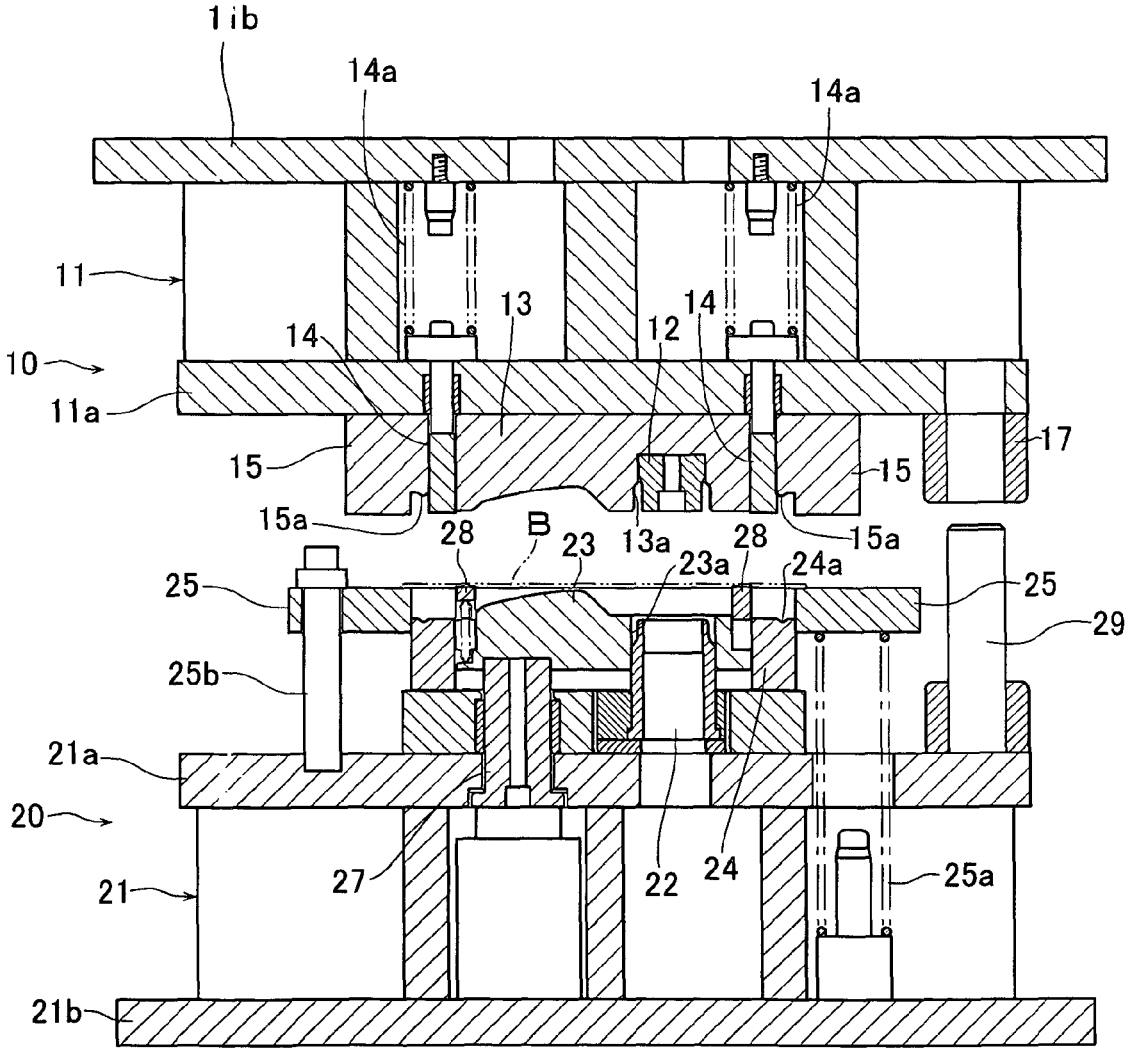
FIG. 1 is a construction view showing one example of a press forming apparatus in accordance with the present invention.

Examples of the present invention will now be described in detail. FIG. 1 is a construction view showing one example of a press forming apparatus for a sheet material in accordance with the present invention. The press forming apparatus of this example is a press forming apparatus for manufacturing an end plate or a front plate of a vehicular silencer.

This press forming apparatus comprises an upper die 10 in which an upper drawing die 13 provided with a punch 12, an upper movable blank holder 14, and a trimming member 15 are provided on an upper die body 11, and a lower die 20 in which a lower drawing die 23 provided with a die 22, an outer periphery drawing die 24, and a lower movable blank holder 25 are provided on a lower die body 21, and therefore press forms a sheet material by the lowering of the upper die 10 that is provided so as to be movable vertically with respect to the lower die 20 that is provided so as to be stationary.

The upper die body 11 has a holder 11*a* in the lower part and a top plate 11*b* in the upper part, and the upper drawing die 13 is fixedly provided in the central portion of the holder 11*a*. The left-hand side of the lower surface of the upper drawing die 13 corresponds to the curved outer surface shape in the inside portion of the end plate, and is formed into a forming shape having a predetermined curved shape that has a flat portion in the outer peripheral portion and is upwardly convex. The right-hand side of the lower surface of the upper drawing die 13 corresponds to the flat outer surface shape in the inside portion of the end plate, and is formed into a flat forming shape. The punch 12 is installed in a concave hole 13*a* provided at a predetermined position of the flat forming surface on the right-hand side of the upper drawing die 13, and the tip end thereof is positioned at the same height as that of the flat forming surface of the upper drawing die 13. The upper movable blank holder 14 is arranged at the outer periphery of the upper drawing die 13 so as to be movable in the vertical direction, and is installed to a damper 14*a* provided on the top plate 11*b* so as to pass through the holder 11*a*, by which the upper movable blank holder 14 is urged downward with respect to the upper die body 11. The trimming member 15 is arranged at the outer periphery of the movable blank holder 14, and is fixed to the holder 11*a*. This trimming member 15 is constructed so that the lower end thereof is used as a blank holder, and is provided with a downwardly projecting bending portion 15*a* in the step portion on the inside at the lower end thereof so that the trimming member 15 is also used as a bending die. The edge on the inside at the lower end of the trimming member 15 is formed into a cutting blade.

The lower die body 21 has a holder 21*a* in the upper part and a base 21*b* in the lower part. The lower drawing die 23 is arranged so as to be movable in the vertical direction with respect to the lower die body 21, and the lower surface of the lower drawing die 23 is supported by a plurality of dampers 27 of a gas spring type, hydraulic type, or the like which are installed on the base 21*b* and project from the holder 21*a*, by which the lower drawing die 23 is urged upward so as to be capable of applying pressure in the upward direction. The upper surface of the lower drawing die 23 is formed into a forming surface corresponding to the forming surface of the upper drawing die 13. The die 22 passes through a through hole 23*a* provided in the flat portion on the right-hand side of the lower drawing die 23 and is fixed to the holder 21*a*, and the tip end of the die 22 is flush with the flat forming surface of the lower drawing die 23 in the through hole 23*a*. In the outer periphery portion of the lower drawing die 23, an upwardly urged work delivery element 28 is planted. The outer periphery drawing die 24 is arranged at the outer periphery of the lower drawing die 23, and is fixed to the holder 21. The edge on the outside at the upper end of the outer periphery drawing die 24 is formed into a cutting blade so that the outer periphery drawing die 24 plays a role of a trimming member, and a downwardly concaved bending portion 24*a* is provided at the upper end of the outer periphery drawing die 24 so that the outer periphery drawing die 24 also has a function of a bending die. The lower movable blank holder 25 is fitted on a guide 25*b* erected on the holder 21*a*, and thereby is arranged so as to be movable in the vertical direction along the outer periphery of the outer periphery drawing die 24. Also, the lower movable blank holder 25 is installed to a damper 25*a* that is provided on the base 21*b* and passes through the holder 21*a*, and thereby is urged upward with respect to the lower die body 21.

In the outermost portions of the holder 11*a* of the upper die body 11 and the holder 21*a* of the lower die body 21, guides 17 and 29, which are fitted to each other by the lowering of the upper die 10 to guide the straight lowering of the upper die 10, are provided, respectively.

An operation for press forming an end plate from a blank B of a sheet material by using the press forming apparatus will be explained with reference to FIGS. 2 to 4.

The blank B is placed on the lower movable blank holder 25 of the lower die 20 shown in FIG. 1. When the upper die 10 located at the top dead center is lowered with respect to the lower die 20, the trimming member 15 of the upper die 10 abuts on the lower blank holder 25 of the lower die 20 via the blank B, whereby the outer periphery portion of the blank B is pressed by the trimming member 15 and the lower blank holder 25.

Figure 2:
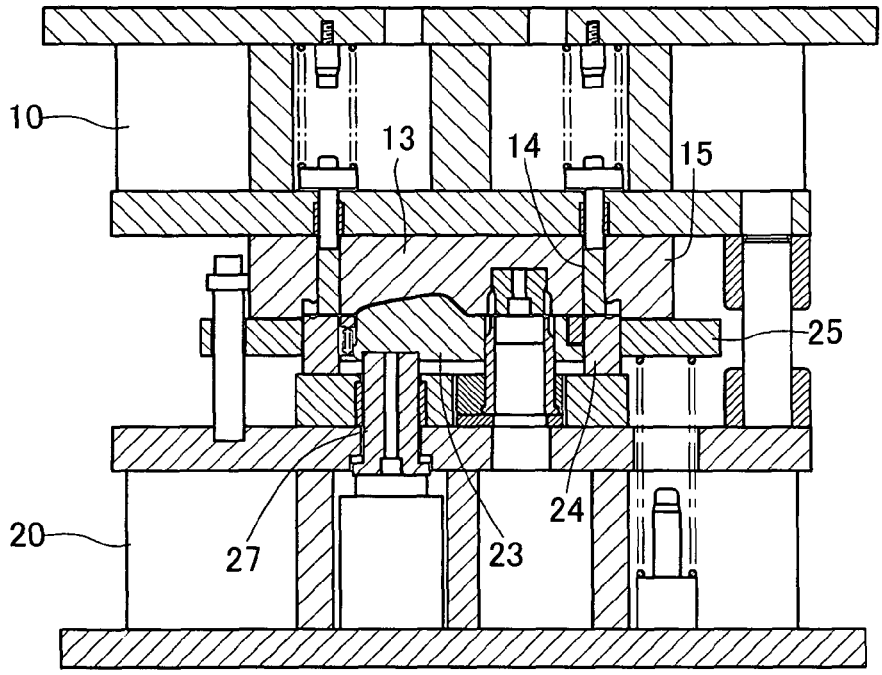
FIG. 2 is an explanatory view showing a pressing operation of the apparatus shown in FIG. 1.

When the upper die 10 is further lowered, as shown in FIG. 2, the upper movable blank holder 14 and the outer periphery drawing die 24 of the lower die 20 hold a portion close to the inside of the outer periphery portion of the blank B, and in this state, the upper drawing die 13 abuts on the lower drawing die 23 under low pressure via the blank B. At this time of abutment, the lower drawing die 23 is moved upward under pressure by the damper 27 to draw the central portion of the blank B by the forming surface of the upper drawing die 13 and the forming surface of the lower drawing die 23, by which the left portion of the blank B is formed into a predetermined upwardly curved shape. Owing to this pre-forming of the central portion of the blank B, the lower drawing die 23 plays a role of a shape pad at the time of subsequent overall forming. On the other hand, while the trimming member 15 lowers and pushes the lower blank holder 25 downward, the outer periphery portion of the blank B is cut by the edge (cutting blade) on the inside at the lower end of the trimming member 15 and the edge (cutting blade) on the outside at the upper end of the outer periphery drawing die 24, so that the outer periphery portion of the blank B is trimmed into a predetermined shape.

Figure 3:
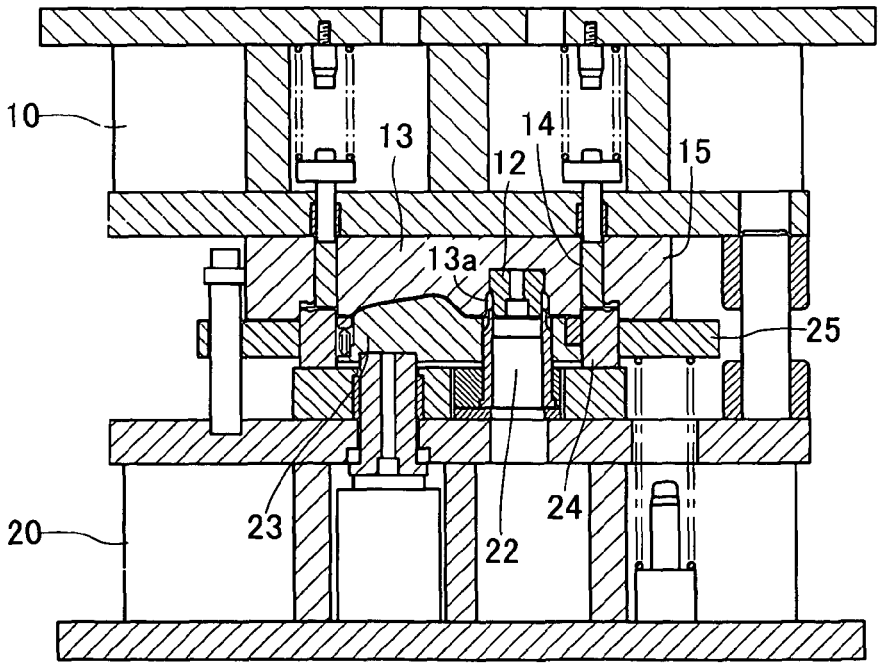
FIG. 3 is an explanatory view showing the continuation of FIG. 2.

Then, when the upper die 10 is further lowered, the upper drawing die 13 lowers and pushes the lower drawing die 23 downward against the damper 27, and as shown in FIG. 3, the inside of the outer periphery portion of the blank B held by the upper blank holder 14 and the outer periphery drawing die 24 is drawn by the upper drawing die 13 and the outer periphery drawing die 24, by which the overall forming of the blank B is started. At the same time, the tip end of the punch 12 enters the inside of the die 22 to punch out the blank B, by which a pierced hole is formed at a predetermined position on the right-hand side of the blank B. Furthermore, as the upper die 10 lowers, a gap around the tip end portion of the punch 12 receives the tip end portion of the die 22, and a portion around the pierced hole in the blank B is drawn between the inner wall surface defining the concave hole 13*a* in the upper drawing die 13 and the outer wall surface of the die 22, by which an upward burring operation around the pierced hole is started.

Figure 4:
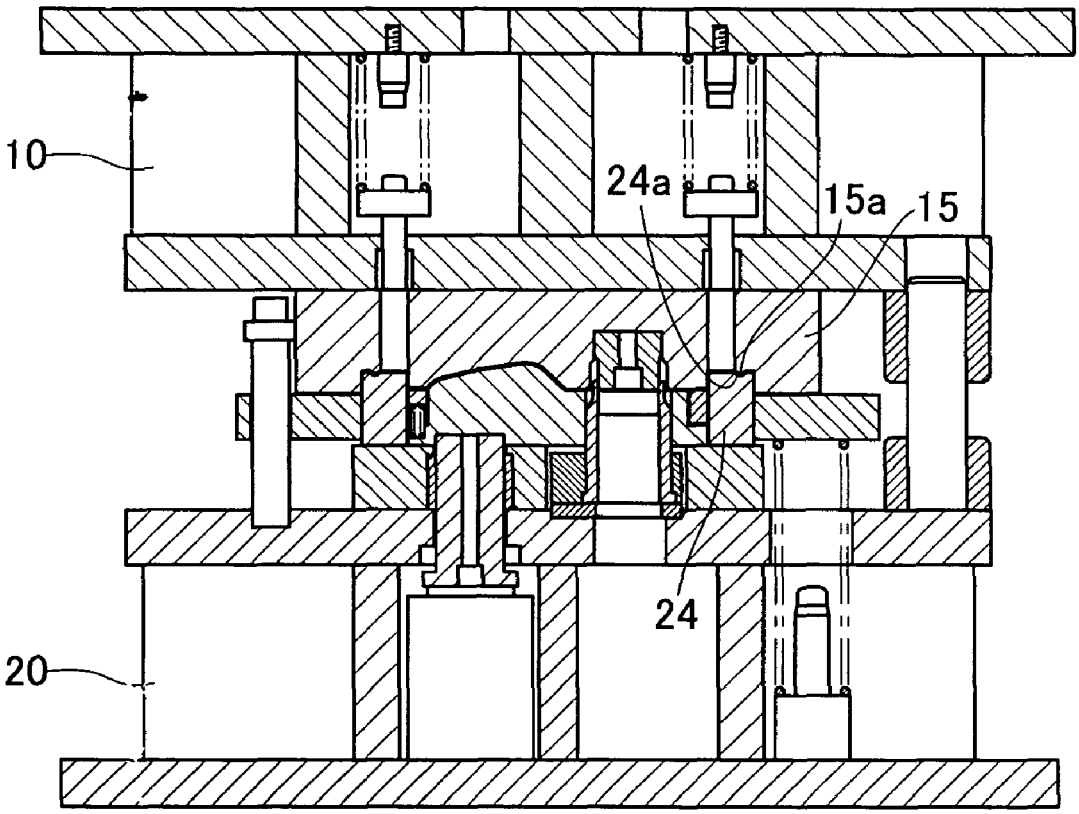
FIG. 4 is an explanatory view showing the continuation of FIG. 3.

When the upper die 10 is further lowered, as shown in FIG. 4, the bending portion 15*a* of the trimming member 15 abuts on and presses the bending portion 24*a* of the outer periphery drawing die 24 via the outermost portion of the blank B, by which the outermost portion of the blank B is upwardly bent to a small extent. By the time when the upper die 10 reaches the bottom dead center, the bending operation of the outermost portion of the blank B is finished. Also, the overall forming operation of the blank B and the burring operation around the pierced hole are also finished, and thus an end plate product is completed. When the upper die 10 is raised and the pressure is relieved, the obtained product is raised by the work delivery element 28 of the lower drawing die 23, and can be taken out of the press forming apparatus.

As described above, according to this example, while shape forming of a sheet material (blank) is performed by drawing, shape forming of secondary working of trimming, bending, piercing and burring is performed, so that an end plate of a silencer can be manufactured by one cycle of pressing operation of a sheet material. Also, some of a plurality of processes are started at the same time, or during one process, other processes are started, so that the working stroke does not become long. Furthermore, since the trimming member for trimming the outer periphery portion of the sheet material is fixed to the upper die body and the lower die body, a backup mechanism (guide mechanism) for the trimming member or the like mechanism is not needed.

Figure 5:
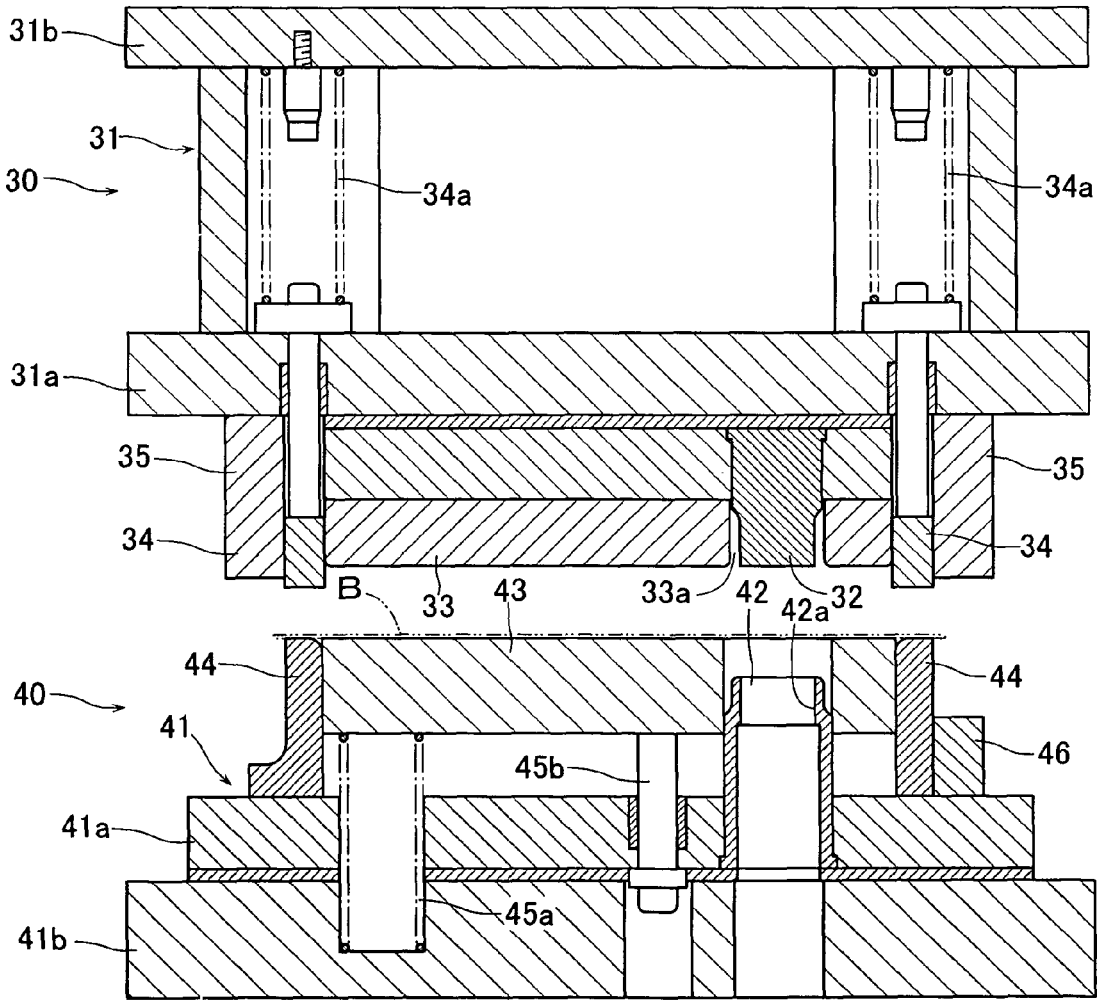
FIG. 5 is a construction view showing another example of a press forming apparatus in accordance with the present invention.
Figure 6:
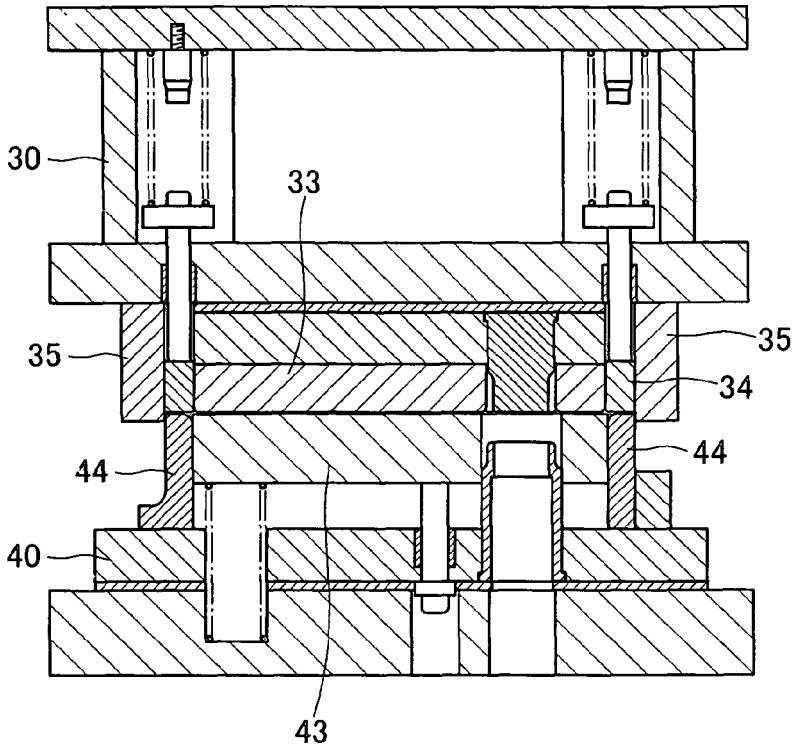
FIG. 6 is an explanatory view showing a pressing operation of the apparatus shown in FIG. 5.
Figure 7:
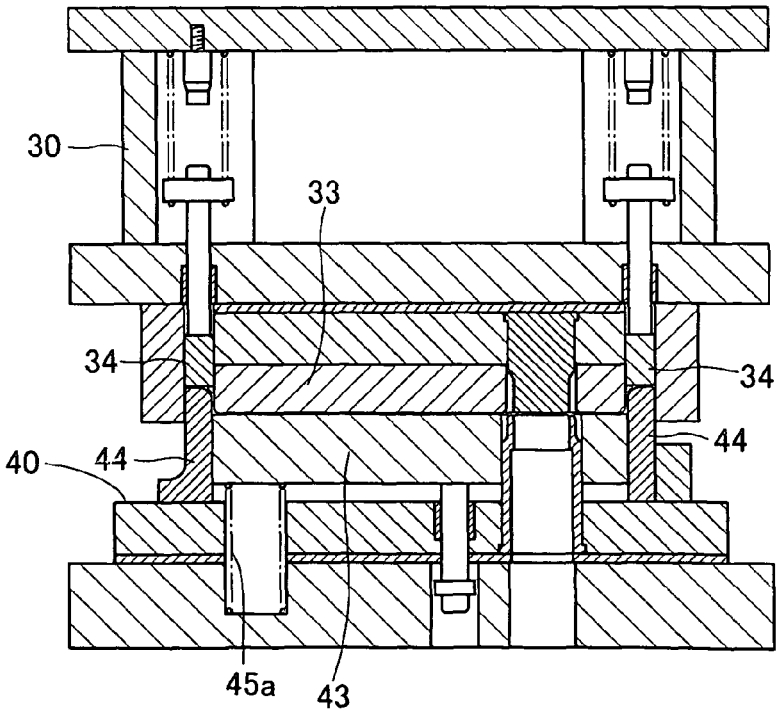
FIG. 7 is an explanatory view showing the continuation of FIG. 6.
Figure 8:
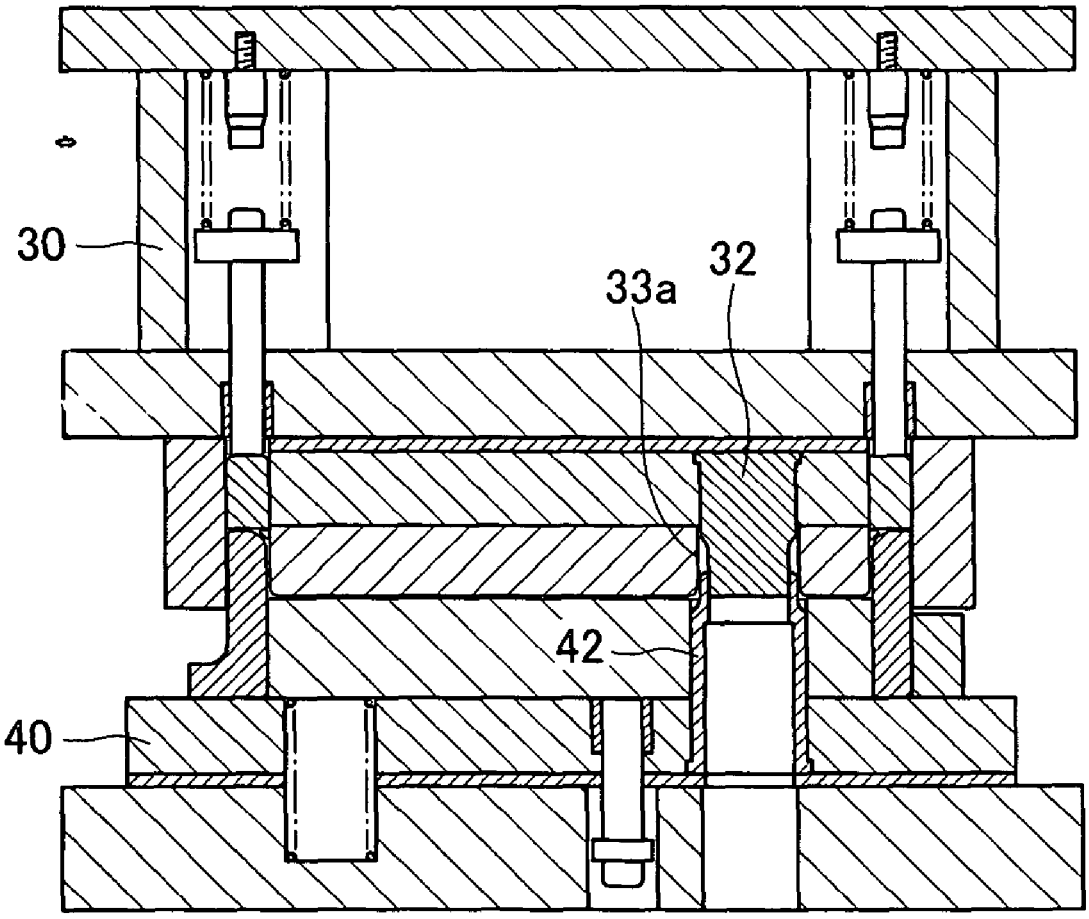
FIG. 8 is an explanatory view showing the continuation of FIG. 7.

Another example of the present invention is shown in FIGS. 5 to 8. In this example, press forming of a separator of a silencer is described. FIG. 5 is a construction view showing a press forming apparatus for forming the separator, and FIGS. 6 to 8 are views showing a press forming operation for the separator performed by using the apparatus shown in FIG. 5. This press forming apparatus comprises an upper die 30 in which an upper drawing die 33 provided with a punch 32, a movable blank holder 34, and a trimming member 35 are provided on an upper die body 31, and a lower die 40 in which a lower drawing die 43 provided with a die 42 and an outer periphery drawing die 44*a* are provided on a lower die body 41.

The upper drawing die 33 is fixedly provided in the central portion of a holder 31*a* in the lower part of the upper die body 31, and the lower surface of the upper drawing die 33 is formed into a flat forming surface. The punch 32 passes through a through hole 33*a* provided at a predetermined position on the right-hand side of the upper drawing die 33 and is installed to the holder 31*a*, and the tip end thereof is positioned at the same height as that of the forming surface of the upper drawing die 33. The upper movable blank holder 34 is arranged at the outer periphery of the upper drawing die 33 so as to be movable in the vertical direction, and is installed to a damper 34*a* provided on a top plate 31*b* so as to pass through the holder 31*a*, by which the upper movable blank holder 34 is urged downward with respect to the upper die body 31. The trimming member 35 is arranged at the outer periphery of the movable blank holder 34, and is fixed to the holder 31*a*. The edge on the inside at the lower end of the trimming member 35 is formed into a cutting blade.

The lower drawing die 43 is supported by a guide 45*b* passing through a holder 41*a* of the lower die body 41, and is provided so as to be movable in the vertical direction. Also, the lower drawing die 43 is installed to a damper 45*a* that passes through the holder 41*a* and is provided on a base 41*b*, and thereby is urged upward with respect to the lower die body 41. The upper surface of the lower drawing die 43 is formed into a flat forming surface as the forming surface of the upper drawing die 33. The die 42 passes through a through hole 42*a* provided at a predetermined position on the right-hand side of the lower drawing die 43 and is fixed to the base 41*b*, and the tip end of the die 42 is flush with the forming surface of the lower drawing die 43 in the through hole 42*a*. The outer periphery drawing die 44 is arranged at the outer periphery of the lower drawing die 43, and is fixed to the holder 41*b*. The upper end of the outer periphery drawing die 44 is also used as a blank holder, and the edge on the outside at the upper end of the outer periphery drawing die 44 is formed into a cutting blade so as to be also used as a trimming member.

At the outer periphery of the outer periphery drawing die 44 on the holder 41*a*, a scrap cutter 46 is provided at two or more locations so that an annular scrap produced at the outer periphery of the die 44 by the trimming operation of a blank B is divided into pieces to prevent the scrap from remaining in the die.

By using the above-mentioned press forming apparatus, a separator of a silencer is press formed from a blank B of a sheet material as described below. A blank B is placed on the outer periphery drawing die 44 of the lower die 40 shown in FIG. 5. When the upper die 30 is lowered with respect to the lower die 40, the movable blank holder 34 of the upper die 30 abuts on the outer periphery drawing die 44 via the blank B, and the outer periphery portion of the blank B is held by the movable blank holder 34 and the outer periphery drawing die 44. When the upper die 30 is further lowered, as shown in FIG. 6, the movable blank holder 34 and the outer periphery drawing die 44 hold a portion close to the inside of the outer periphery portion of the blank B, and in this state, the trimming member 35 lowers to cut the outer periphery portion of the blank B by means of the edge (cutting blade) of the trimming member 35 and the edge (cutting blade) of the outer periphery drawing die 44, by which the outer periphery portion of the blank B is trimmed into a predetermined shape. The upper drawing die 33 abuts on the lower drawing die 43 via the blank B, and the central portion of the blank B is pressed by the drawing dies 33 and 43 that play a role of a shape pad.

Then, when the upper die 30 is further lowered, the upper drawing die 33 lowers and pushes the lower drawing die 43 downward against the damper 45*a*, and as shown in FIG. 7, while the outer periphery portion of the blank B held by the movable blank holder 34 and the outer periphery drawing die 44 is pulled out, the outer periphery portion of the blank B is drawn by the upper drawing die 33 and the outer periphery drawing die 44 so as to be drawn up, by which the outer periphery portion of the blank B begins to be formed into a bend erected perpendicularly to the surface in the central portion of the blank B.

When the upper die 30 is further lowered, as shown in FIG. 8, the tip end of the punch 32 enters the inside of the die 42 to punch out the blank B, by which a pierced hole is formed at a predetermined position on the right-hand side of the blank B. Furthermore, as the upper die 30 lowers, a gap around the tip end portion of the punch 32 receives the tip end portion of the die 42, and a portion around the pierced hole in the blank B is drawn between the inner wall surface of the tip end portion of the through hole 33*a* in the upper drawing die 33 and the outer wall surface of the die 42, by which an upward burring operation around the pierced hole is started. By the time when the upper die 30 reaches the bottom dead center, the burring operation around the pierced hole and the bending operation of the outer periphery portion in the blank B are finished. Thus, a separator product is completed.

As described above, according to this example, a separator of a silencer can be manufactured by one cycle of pressing operation from a sheet material, and the same effect as that of the above-mentioned example can be achieved.

Figure 9:
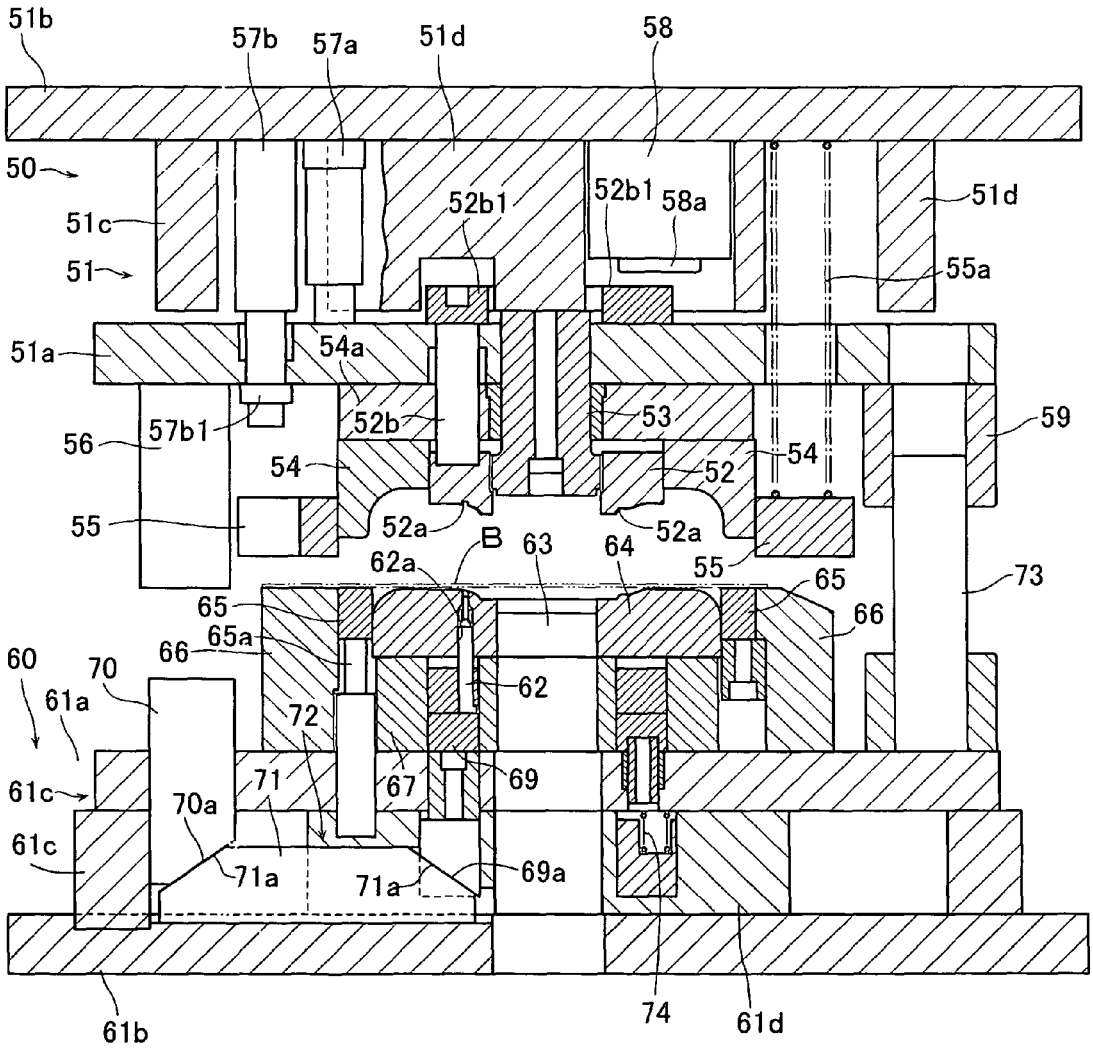
FIG. 9 is a construction view showing still another example of a press forming apparatus in accordance with the present invention.

Still another example of the present invention is explained with reference to FIGS. 9 to 19. This example is an example in which a pump impeller of a torque converter or a shell of a turbine runner is press formed. FIG. 9 is a construction view showing a press forming apparatus for forming the shell, and FIGS. 10 to 13 are explanatory views showing a press forming operation for the shell performed by using the apparatus shown in FIG. 9.

The press forming apparatus of this example comprises an upper die 50 in which a pierced hole periphery die 52, an upper drawing die 54 provided with a punch 53, and an upper movable blank holder 55 are provided on an upper die body 51, and a lower die 60 in which a lower drawing die 64 provided with a coining punch 62, a lower movable blank holder 65, and an outer periphery die 66 are provided on a lower die body 61.

The upper die body 51 has a rectangularly shaped top plate 51*b* and a rectangularly shaped holder 51*a* which is arranged under the top plate 51*b* and is slightly smaller than the top plate 51*b*. On the lower surface of the holder 51*a*, a four-side thick plate shaped pressurizing tool 51*c* is provided at the periphery, and a cylindrical pressurizing tool 51*d* is provided in the center. On the inside of the pressurizing tool 51*c*, there are provided a spring member 57*a* for urging the holder 51*a* downward and a retainer 57*b* which passes through the holder 51*a* and supports the lower surface of the holder 51*a* by means of a supporting portion 57*b*1 at the lower end thereof. The holder 51*a* supported by the retainer 57*b* is hung from the top plate 51*b* so that a predetermined gap is provided between the holder 51*a* and the pressurizing tools 51*c* and 51*d*.

The upper drawing die 54 consists of an annular body, and the lower surface thereof is formed into a forming surface of a basin shape that is convex upward so as to correspond to the outer surface shape of the shell including the outer peripheral flange. The upper drawing die 54 is fixed to the holder 51*a* via a spacer 54*a*.

The pierced hole periphery die 52 consists of an annular body, and the lower surface thereof is formed into a forming surface corresponding to the pierced hole periphery portion of the shell which is continued to the forming surface of the upper drawing die 54. The pierced hole periphery die 52 is arranged concentrically on the inside of the upper drawing die 54, and is installed at the lower ends of a plurality of connecting shafts 52*b* arranged in the circumferential direction with intervals being provided so as to be movable in the vertical direction. The connecting shafts 52*b* pass through the holder 51*a* and are hung by the holder 51*a* by hooking a ring 52*b*1 connecting the upper ends of the connecting shafts 52*b* on to the upper surface of the holder 51*a*. In the pressurizing tool 51*d*, a plurality of spring members 58 are installed along the circumferential direction, which spring members 58 press down the rising connecting shafts 52*b* via the ring 52*b*1 in the head portion to allow the connecting shafts 52*b* to operate as a damper. The spring members 58 are installed on the lower surface of the top plate 51*b*. The configuration may be such that the spring members 58 are not provided, and the connecting shafts 52*b* are formed by a damper so that the connecting shaft itself has a damper function. The pierced hole periphery die 52 projects in a curved portion on the lower surface of the upper drawing die 54 in a free state in which the connecting shafts 52*b* are hung by the holder 51*a*. At a position close to the center of the forming surface of the pierced hole periphery die 52, a plurality of small concave portions 52*a* for coining are provided.

The punch 53 is arranged concentrically on the inside of the pierced hole periphery die 52, and passes through the holder 51*a* and is fixed to the pressuring tool 51*d* with a bolt. The tip end of the punch 53 is flush with the lower surface of the pierced hole periphery die 52 at the same height as that of the forming surface of the upper drawing die 54. The upper movable blank holder 55 consists of an annular body arranged at the outer periphery of the upper drawing die 54, and is installed at the lower ends of a plurality of dampers 55*a* urging downward so as to be movable in the vertical direction. In this state, the upper movable blank holder 55 projects downward from the upper drawing die 54. The dampers 55*a* pass through the holder 51*a* and are installed on the lower surface of the top plate 51*b*.

At four corners of the lower surface of the holder 51*a*, there is provided a guide cylinder which fits on a guide rod 73 of the lower die 60 to guide the straight lowering of the upper die 50. Also, on both right and left sides of the lower surface of the holder 51*b*, a push arm 56 for operating a coining punch driving mechanism 72 of the lower die 60 is installed.

The lower die body 61 comprises a holder 61*a* in an upper part and a base 61*b* in a lower part, and the holder 61*a* is fixed to the base 61*b* via a supporting tool 61*c*. The lower drawing die 64 consists of an annular body, and the upper surface thereof is formed into a brimless basin-shaped forming surface that is convex upward so as to correspond to the outer surface shape of the shell excluding the outer peripheral flange thereof. The inner periphery portion of the forming surface of the lower drawing die 64 is formed into a shallow concave shape corresponding to the pierced hole periphery portion of the shell, and a through hole 63 corresponding to the punch 53 is formed in the central portion of the lower drawing die 64. The lower drawing die 64 is fixed on a support 67 provided on the upper surface of the holder 61*a*.

The coining punch 62 is provided so that the lower end of the punch 62 is installed to a vertically movable member 69, which passes through the holder 61*a* and is movable in the vertical direction, so as to be movable in the vertical direction in a through hole 62*a* formed in the lower drawing die 64, and the tip end of the punch 62 is flush with the upper surface of the inner periphery portion of the lower drawing die 64. The vertically movable member 69 constitutes a driving mechanism 72 for the coining punch 62.

The lower movable blank holder 65 consists of an annular body arranged at the outer periphery of the lower drawing die 64, and is installed at the upper ends of a plurality of dampers 65*a* urging upward so as to be movable in the vertical direction. In this state, the upper end of the lower movable blank holder 65 is positioned slightly above the lower drawing die 64. The dampers 65*a* pass through the holder 61*a* and are fixed to a supporting tool 61*d* of the lower die body 61.

The trimming member 66 is an annular member in which the inside edge at the upper end plays a role of a cutting blade, and which is also used as a lower blank holder, and is arranged at the outer periphery of the lower movable blank holder 65 and fixed on the holder 61*a*. The guide rod 73 is provided at four corners of the holder 61*a* so as to correspond to the guide cylinder 59 of the upper die 50.

The coining punch driving mechanism 72 is a kind of cam mechanism, and is provided on both right and left sides of the lower die body. The coining punch driving mechanism 72 comprises a receiving member 70 in the vertical direction, a horizontally movable member 71 in the horizontal direction, and the above-mentioned vertically movable member 69 in the vertical direction. The trapezoidal horizontally movable member 71 is disposed on the base 61*b* so as to be movable horizontally to the right and left. The receiving member 70 passes through the holder 61*a* at the lower position of the push arm 56 of the upper die 50 so as to be movable in the vertical direction, and abuts on the side surface of the vertical member 61*c* provided in the lower die body 61 so as to be guided. An inclined surface 70*a* at the lower end of the receiving member 70 abuts on an inclined surface 71*a* at one end of the horizontally movable member 71, and an inclined surface 69*a* at the lower end of the vertically movable member 69 abuts on the inclined surface 71*a* at the other end of the horizontally movable member 71, by which the cam mechanism is formed. The vertically movable member 69 is urged downward by a return spring 74 provided in the supporting tool 61*d* of the lower die body 61. The push arm 56 is allowed to abut on the receiving member 70 by the lowering of the upper die 50, and the receiving member 70 is pushed to lower. Then, the horizontal movable member 71 is pushed by the receiving member 70 and is moved to the inside in the horizontal direction, and the vertical movable member 69 is pushed upward against the spring 74 by the horizontally movable member 71, so that the coining punch 62 installed to the vertically movable member 69 projects from the tip end of the through hole 62*a* in the upper drawing die 64.

Figure 10:
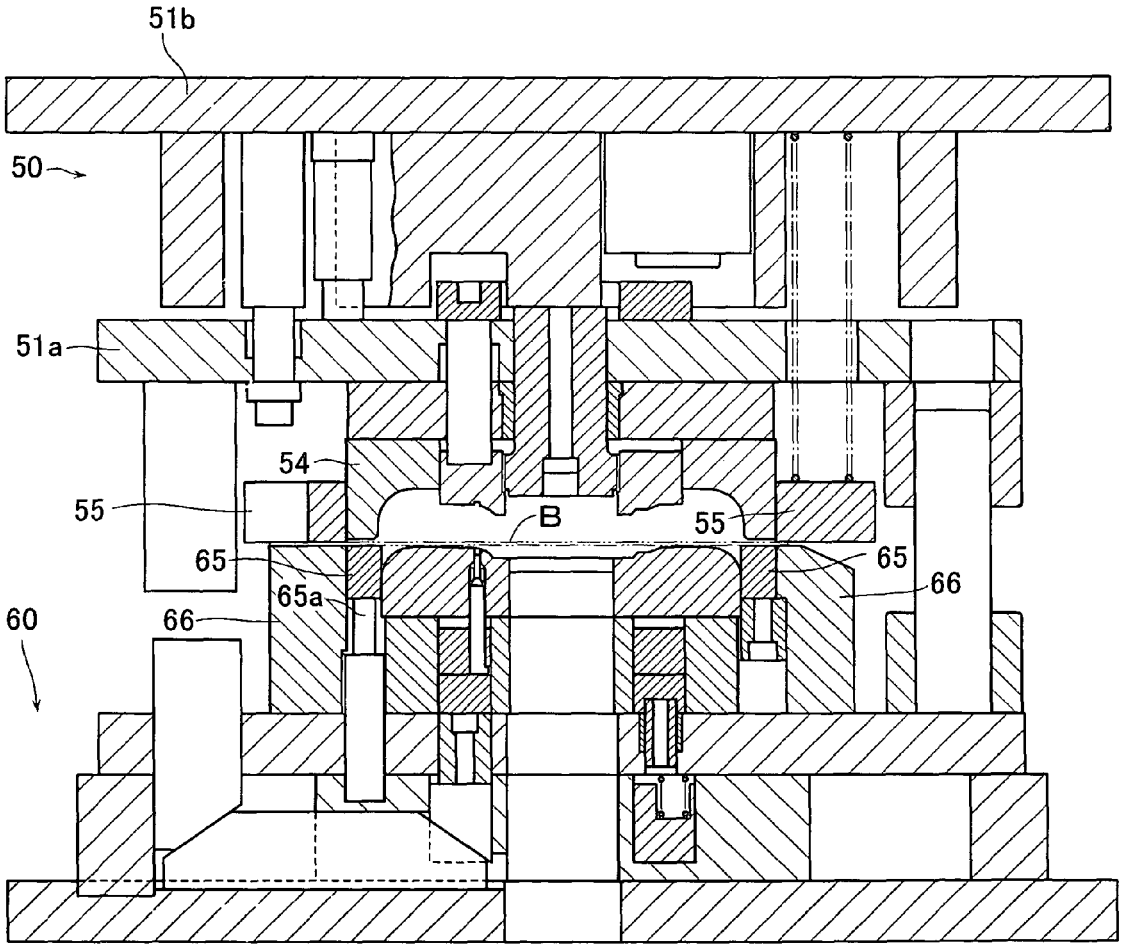
FIG. 10 is an explanatory view showing a pressing operation of the apparatus shown in FIG. 9.

The shell is formed as described below by this press forming apparatus. As shown in FIG. 9, in a state in which the upper die 50 is located at the top dead center, a blank B is placed on the lower movable blank holder 65 and the trimming member 66 of the lower die 60. When the top plate 51*b* is lowered by an elevating means, not shown, installed to the top plate 51*b* of the upper die 50, the whole of the upper die 50 including the holder 51*a* pressed by the spring member 57 lowers with respect to the lower die 60. As shown in FIG. 10, the upper movable blank holder 55 of the upper die 50 abuts on the trimming member 66 via the blank B so that the outer periphery portion of the blank B is pressed by the upper movable blank holder 55 and the trimming member 66. Then, the flat outer periphery portion of the upper drawing die 54 abuts on the lower movable blank holder 65 via the inside portion of the outer periphery portion of the blank B.

Figure 11:
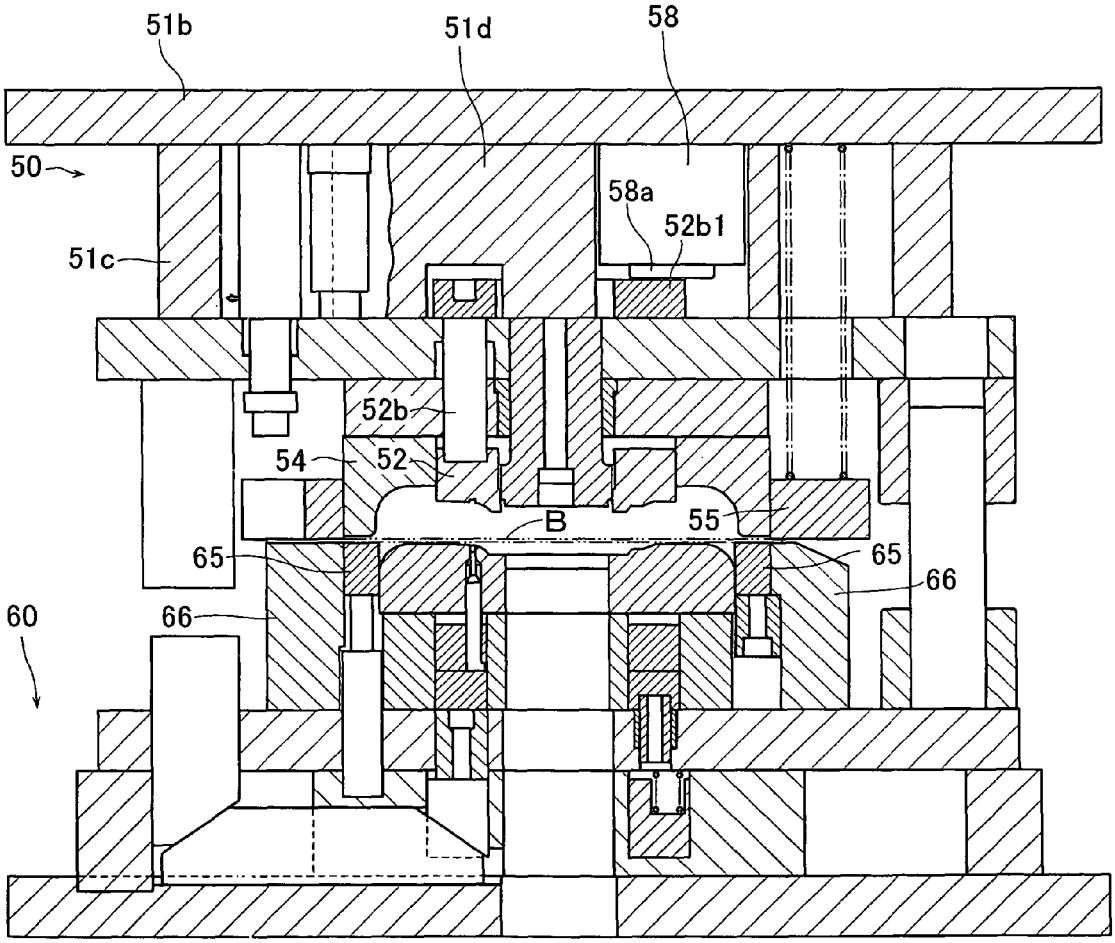
FIG. 11 is an explanatory view showing the continuation of FIG. 10.

Thus, the lowering of the holder 51*a* is once stopped by the resistance force of the blank B the outer periphery portion of which is cut by the edge (cutting blade) at the outer periphery of the upper drawing die 54 and the edge (cutting blade) at the inner periphery of the trimming member 66, and only the top plate 51*b* lowers. As shown in FIG. 11, the pressurizing tools 51*c* and 51*d* installed on the top plate 51*b* abut on the holder 51*a*, by which the holder 51*a* is pressed and lowered. Therefore, the flat outer periphery portion of the upper drawing die 54 pushes the lower movable blank holder 65 downward, and the edge (cutting blade) at the outer periphery of the upper drawing die 54 and the edge (cutting blade) at the inner periphery of the trimming member 66 cut the outer periphery portion of the blank B, so that the outer periphery portion of the blank B is trimmed into a predetermined circular shape. Also, a push pad 58*a* of the spring member 58 abuts on the ring 52*b*1 of the connecting shafts 52*b*, and presses down the connecting shafts 52*b* downward.

Figure 12:
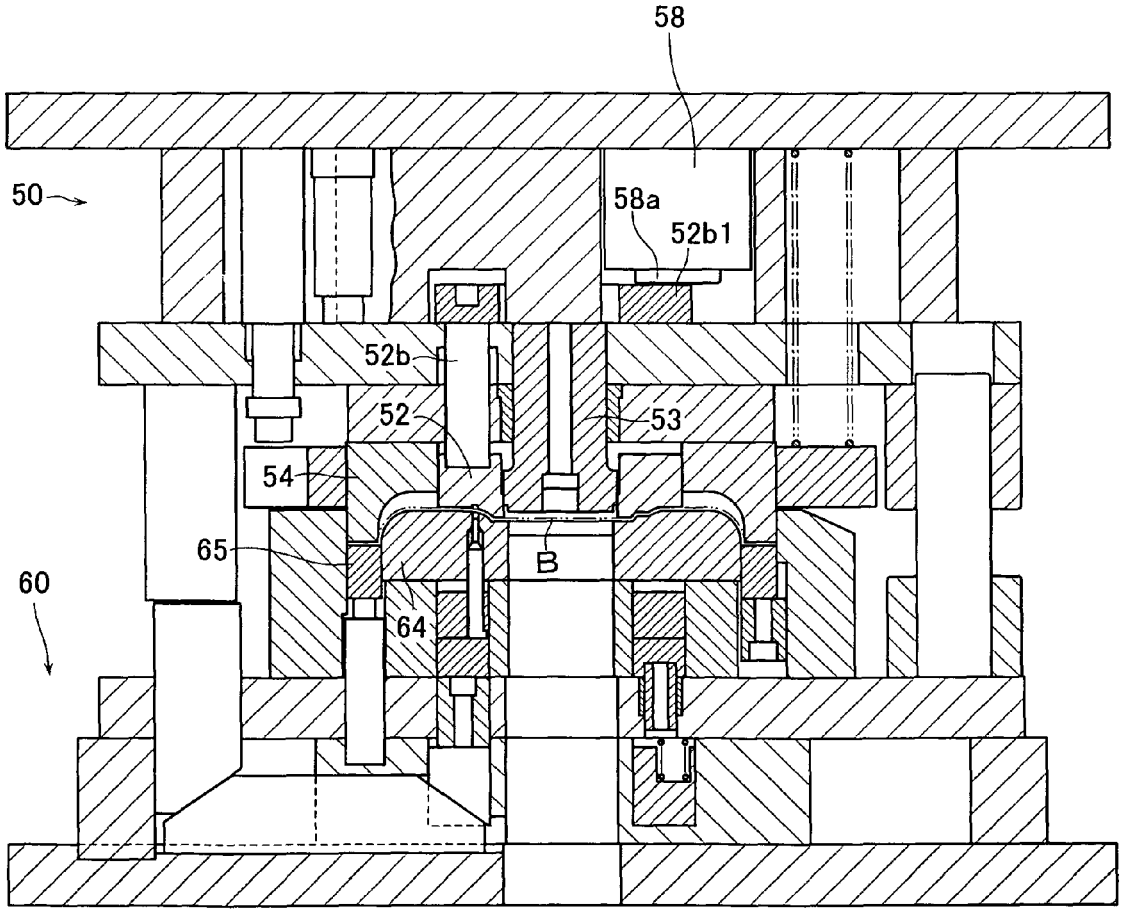
FIG. 12 is an explanatory view showing the continuation of FIG. 11.

When the upper die 50 is further lowered, as shown in FIG. 12, the outer periphery portion of the upper drawing die 54 further pushes the lower movable blank holder 65 downward, and the outer periphery portion of the blank B is held between the outer periphery portion of the upper drawing die 54 and the blank holder 65. In this state, the overall forming operation in which the blank B is drawn along the lower drawing die 64 by the upper drawing die 54 and the lower drawing die 64 is started. At the same time, the pierced hole periphery die 52 at the lower ends of the connecting shafts 52*b* abuts on the inner periphery portion of the lower drawing die 64 via the blank B. The pierced hole periphery die 52 applies downward pressure to the blank B to draw the inner periphery portion of the blank B into a predetermined shape, by which working around the pierced hole is completed. Owing to this preforming operation around the pierced hole of the blank B, the pierced hole periphery die 52 plays a role of a shape pad at the time of pierced hole forming and at the time of overall forming.

Figure 13:
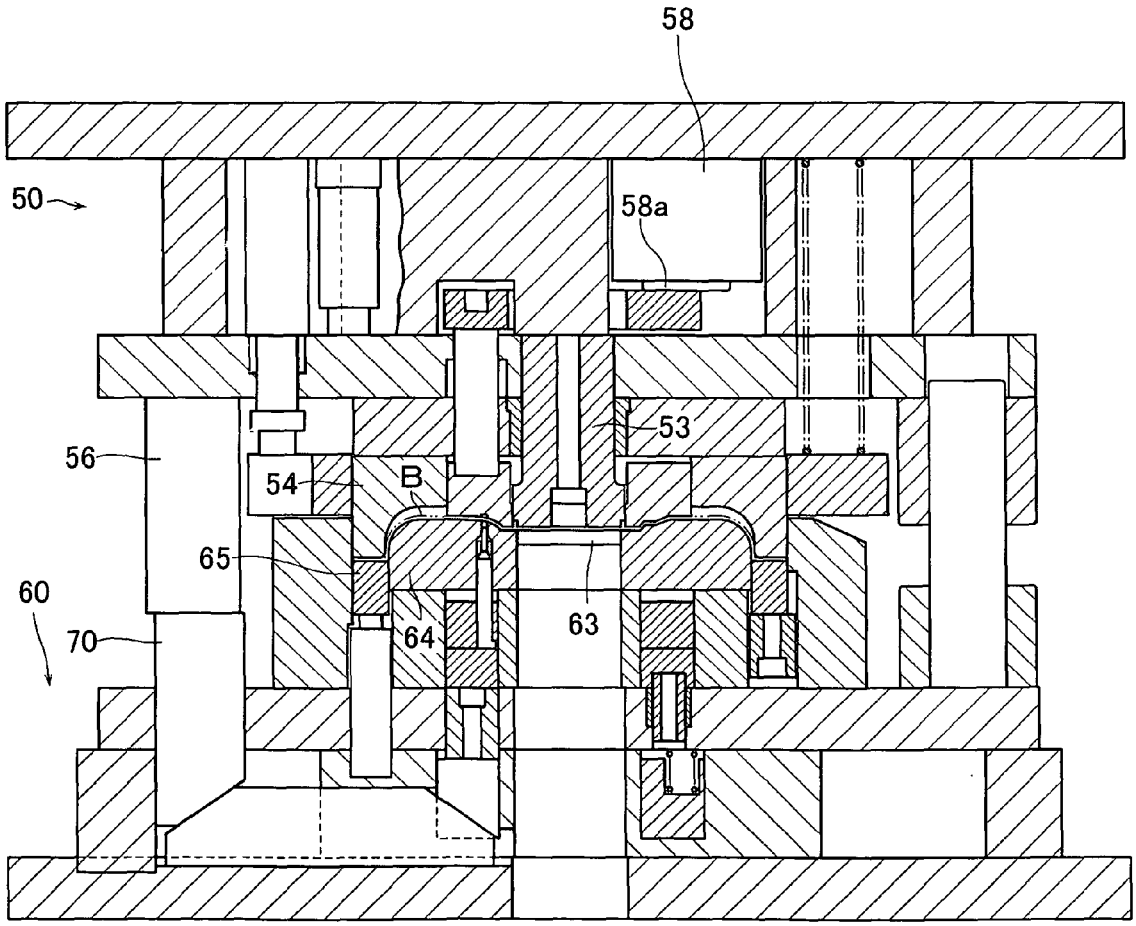
FIG. 13 is an explanatory view showing the continuation of FIG. 12.

When the upper die 50 is further lowered, as shown in FIG. 13, the push pad 58*a* of the spring member 58 of the upper die 50 is retreated by a reaction force from the blank B, and only the punch 53 and the upper drawing die 54 lower. Therefore, the tip end portion of the punch 53 enters the inside of the hole 63 in the lower drawing die 64 to punch out the blank B, by which a pierced hole is formed in the center of the blank B. Also, the outer periphery portion of the upper drawing die 54 further pushes the lower movable blank holder 65 downward, so that the drawing of the central portion of the blank B, namely, the overall forming progresses. At this time, the push arm 56 of the upper die 50 abuts on the receiving member 70 of the lower die 60.

Figure 14:
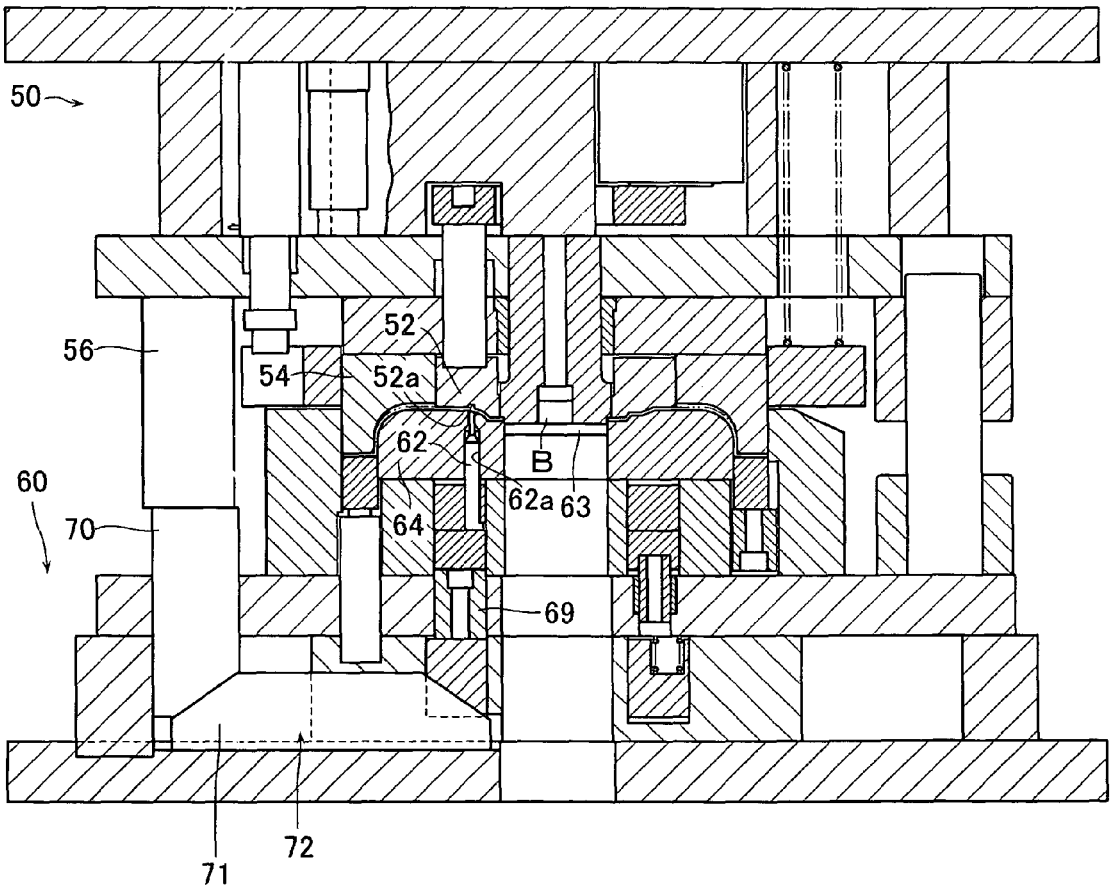
FIG. 14 is an explanatory view showing the continuation of FIG. 13.
Figure 15:
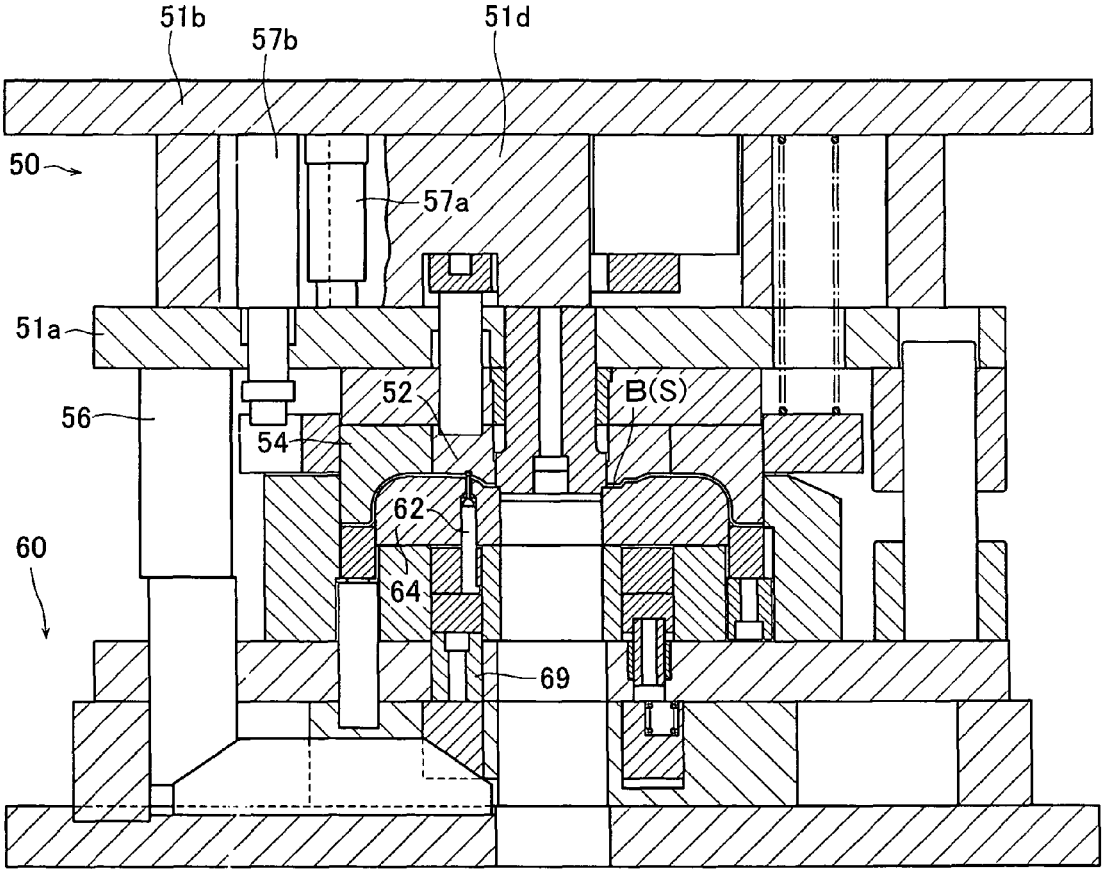
FIG. 15 is an explanatory view showing the continuation of FIG. 14.

When the upper die 50 is further lowered, as shown in FIG. 14, the receiving member 70 of the coining punch driving mechanism 72 moves downward, the horizontal movable member 71 moves to the inside in the horizontal direction, and the vertically movable member 69 moves upward, whereby the coining punch 62 is pushed up, and the tip end of the punch 62 projects from the tip end of the through hole 62*a* in the lower drawing die 64 and is pressed into the concave portion 52*a* of the pierced hole periphery die 52 via the blank B, by which coining, namely, the forming of a groove for blade positioning is started around the pierced hole in the blank B. As shown in FIG. 15, when the upper die 50 reaches the bottom dead center, the overall forming (curved shape of shell and outer peripheral flange) and coining around the pierced hole are finished, by which a shell S is completed.

When the upper die 50 is raised from the bottom dead center after the shell has been completed, the shell can be taken out. If the outer periphery portion of the upper drawing die 54, which abuts on, from the upside, on the flange of the shell S, is raised by raising the upper die 50 while the pierced hole periphery portion of the shell S is pressed from the upside by the pierced hole periphery die 52, the flange of the shell S is pressed upward by the lower movable blank holder 65 of the lower die 60, so that there is a fear that the flange may be deformed.

In this example, the holder 51*a* and the top plate 51*b* of the upper die 50 are not fixed, and only the top plate 51*b* and attached members thereof, such as the pressurizing tool 51*c* are first raised from the upper die 50 located at the bottom dead center by the spring member 57*a* and the retainer 57*b* provided on the top plate 51*b*. Therefore, the deformation of the flange of the shell S can surely be prevented in the rising process of the upper die 50. This process is explained below.

Figure 16:
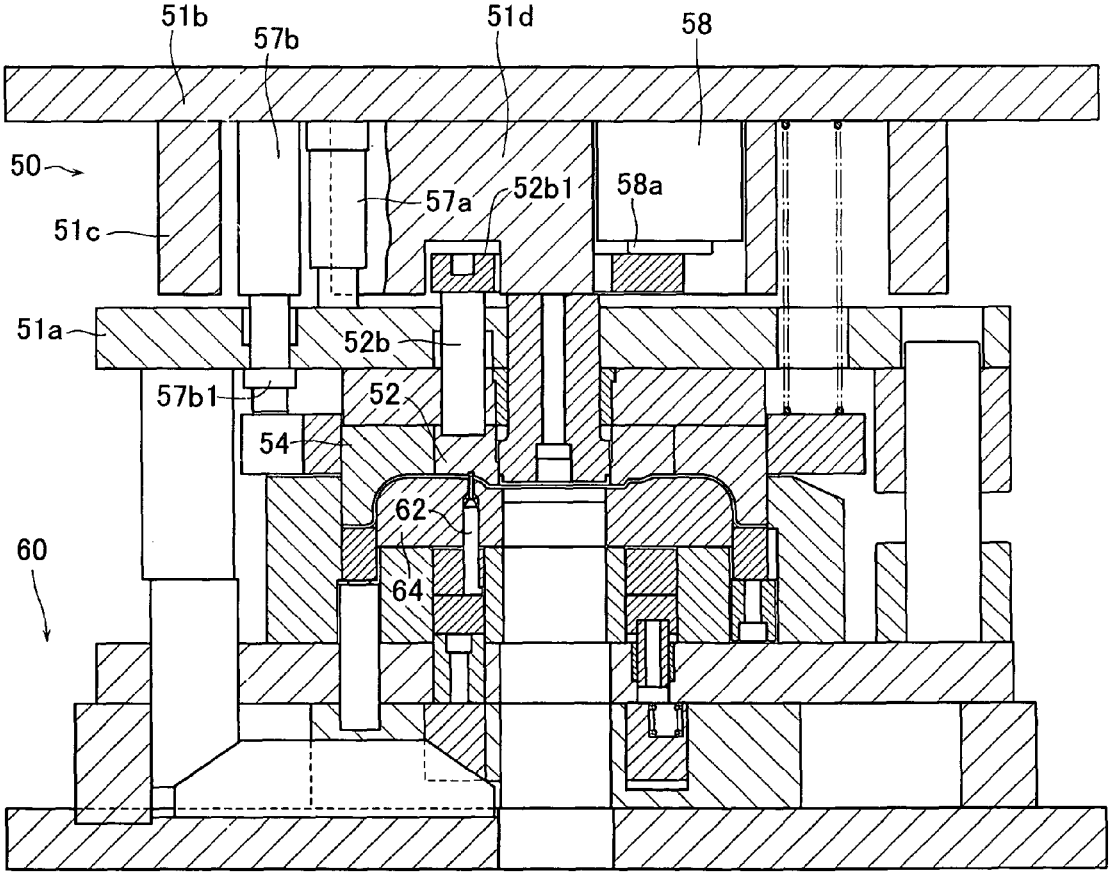
FIG. 16 is an explanatory view showing a pressing operation of the apparatus shown in FIG. 15.

When the top plate 51*b* of the upper die 50 located at the bottom dead center is raised by the elevating means, not shown, as shown in FIG. 16, the holder 51*a* urged downward by the spring member 57*a* of the top plate 51*b* does not move, so that the supporting portion 57*b*1 of the retainer 57*b* installed on the top plate 51*b* abuts on the lower surface of the holder 51*b* and is hooked on to the holder 51*b*. The connecting shafts 52*b* fitted with the pierced hole periphery die 52 are pressed downward by the extending push portion 58*a* of the spring member 58 of the top plate 51*b*, so that the pierced hole periphery die 52 that abuts on the pierced hole periphery portion of the shell S still presses the shell S. Since the holder 51*a* does not rise, the upper drawing die 50 still presses the shell S.

Figure 17:
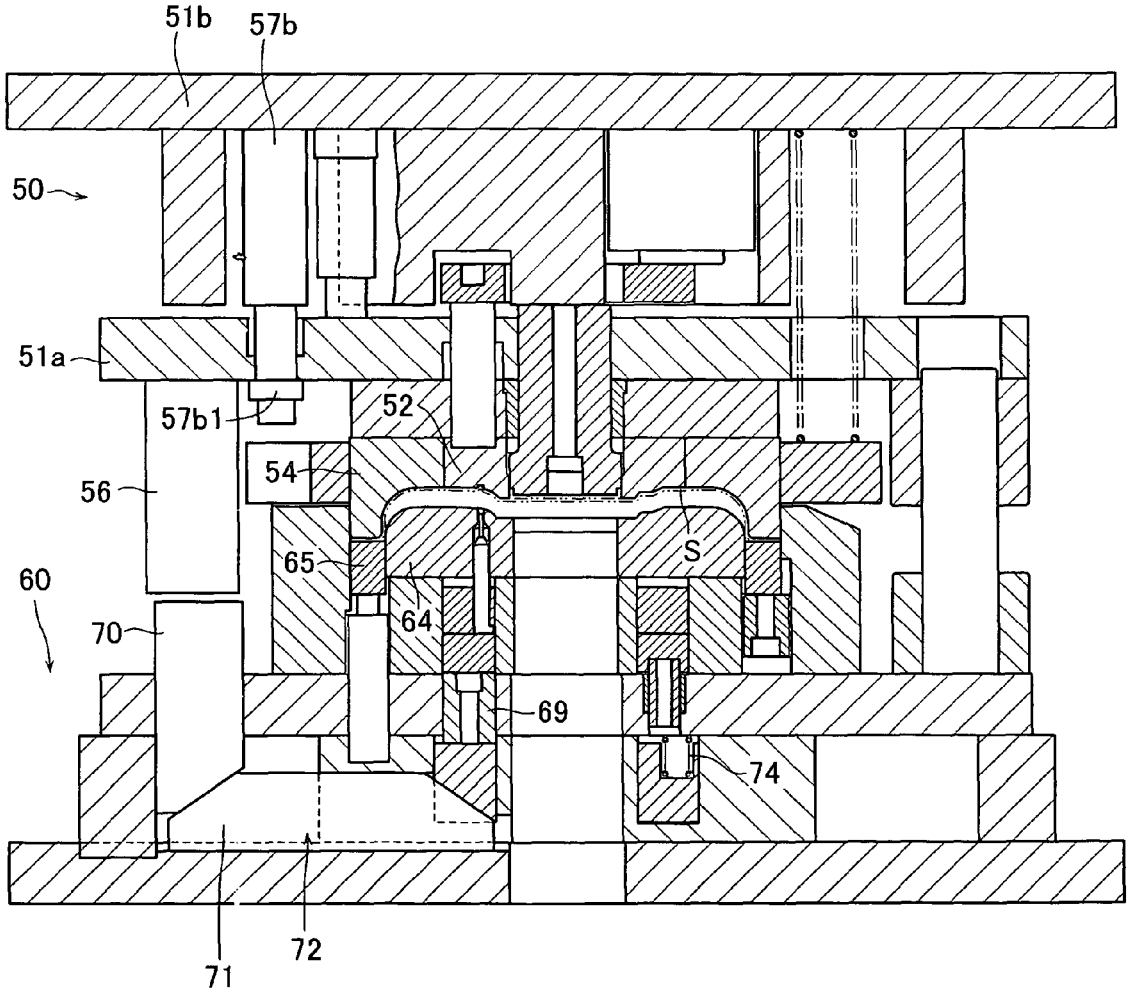
FIG. 17 is an explanatory view showing the continuation of FIG. 16.

When the top plate 51*b* is further raised, as shown in FIG. 17, the holder 51*a* is hung by the retainer 57*b*, by which the whole of the upper die 50 is raised. The whole of the shell S including the flange is raised by the lower movable blank holder 65 of the lower die 60, which pushes the flange of the shell S, while being pressed by the upper drawing die 54 and the pierced hole periphery die 52. Therefore, at the time when the upper die 50 rises, the flange is not deformed by the lower movable blank 65 that pushes the flange of the shell S. Also, the push arm 56 of the holder 51*a* separates from the receiving member 70 of the coining punch driving mechanism 72, the vertically movable member 69 is lowered by the return spring 74, and the coining punch 62 of the vertically movable member 69 lowers. Also, the horizontally movable member 71 is moved to the outside in the horizontal direction by the vertically movable member 69, and the receiving member 70 is raised by the horizontally movable member 71, so that the coining punch driving mechanism 72 returns to the initial position.

Figure 18:
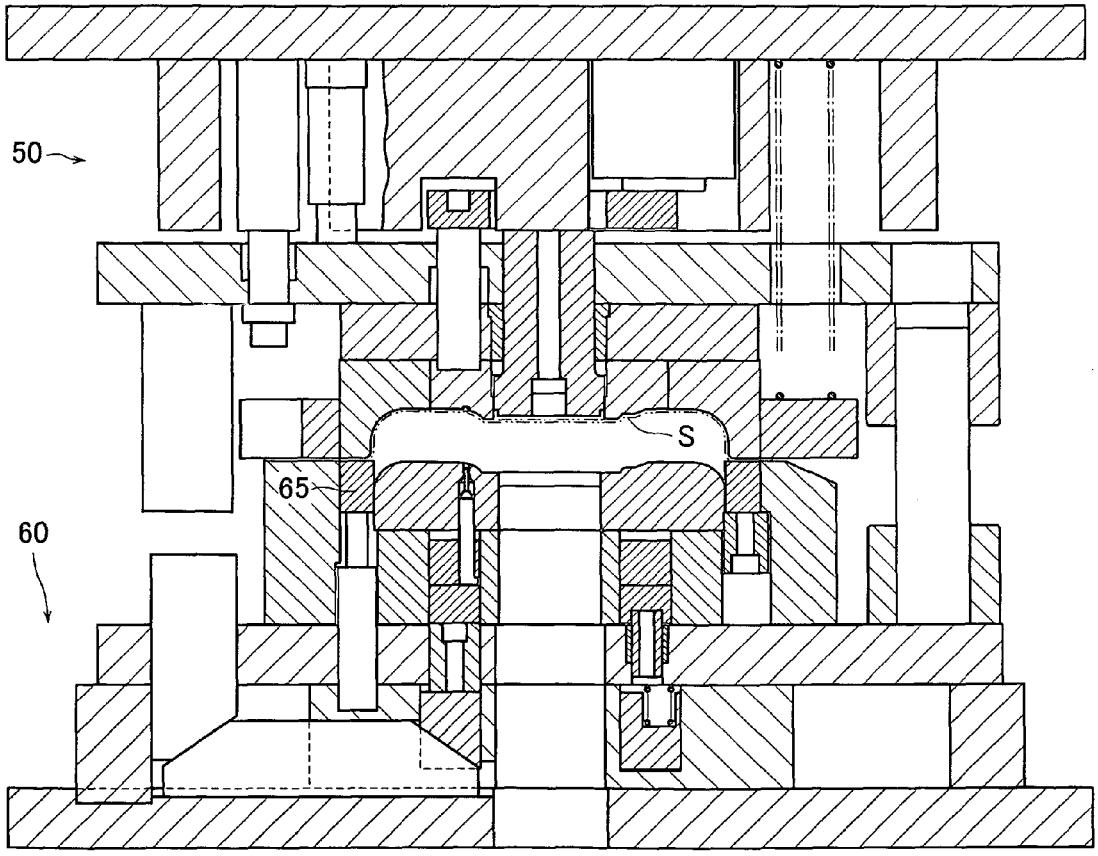
FIG. 18 is an explanatory view showing the continuation of FIG. 17.
Figure 19:
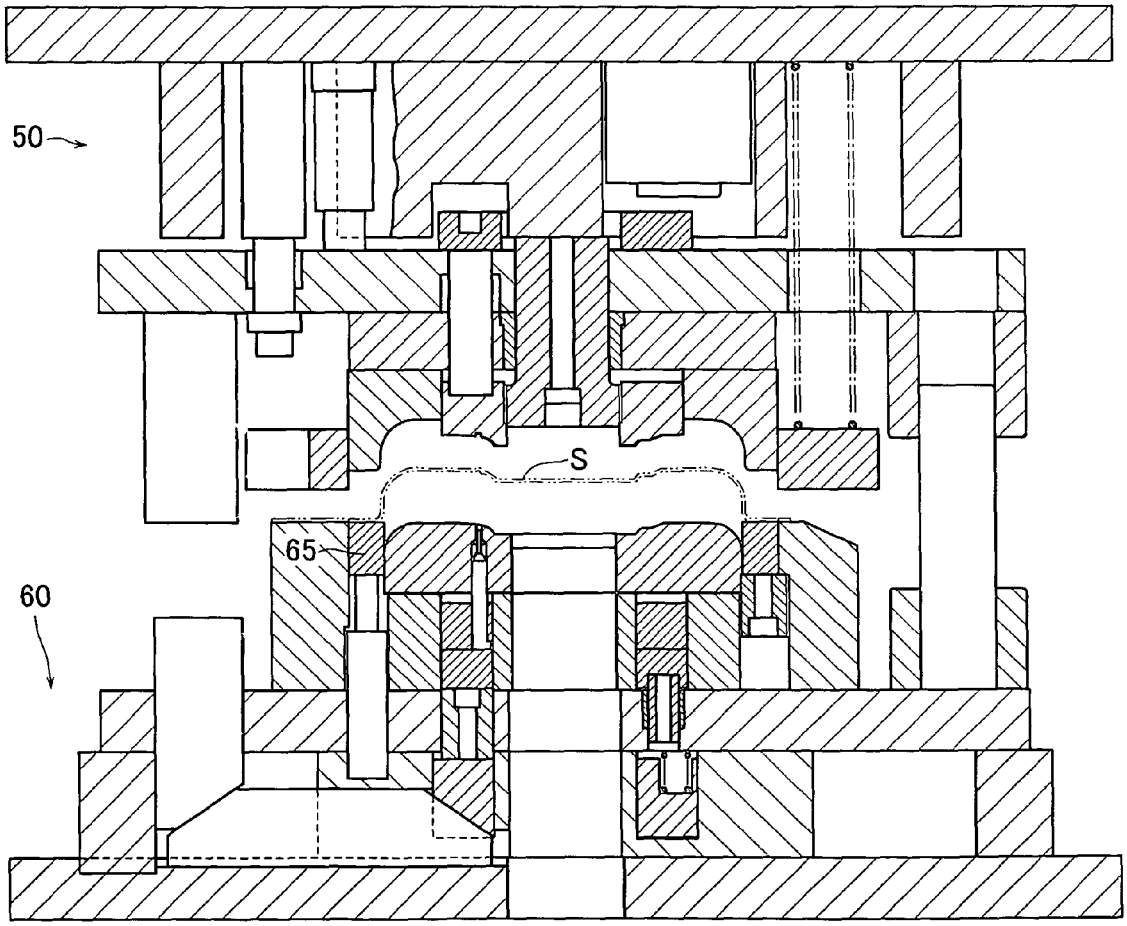
FIG. 19 is an explanatory view showing the continuation of FIG. 18.

When the upper die 50 is further raised, as shown in FIG. 18, the lower movable blank holder 65 extends to the initial upper end position, and the shell S is not pushed up further. Therefore, when the upper die 50 is further raised, as shown in FIG. 19, the shell S drops onto the lower movable blank holder 65 by its gravity, and the shell S is taken out from between the upper die 50 having reached the top dead center and the lower die 60.

As described above, according to this example, a pump impeller of a torque converter or a shell product of a turbine runner can be manufactured by one cycle of pressing operation from a sheet material, and the same effect as that of the above-mentioned examples can be achieved.

What is claimed is:

1. A press forming method for a sheet material, in which an upper die provided with one of a plurality of dies for drawing a sheet material and one of a plurality of secondary working members separate from the dies, which perform secondary working, which comprises at least one of trimming, piercing, burring, bending, or coining of the sheet material, is lowered with respect to a lower die provided with another one of the dies and another one of the secondary working members, and in which the upper die is provided with an upper drawing die, a pierced hole periphery die having a concave portion for coining, a punch, and an upper blank holder is lowered with respect to a lower die provided with a lower drawing die having a punch housing hole, a coining punch, a lower blank holder, and a trimming member also used as a blank holder, wherein the sheet material is substantially formed during a single cycle of pressing operation;

wherein the outer periphery portion of a blank placed on the trimming member is held by the trimming member and the upper blank holder;

successively, the outer periphery portion of the blank is trimmed by the upper drawing die and the lower blank holder;

successively, overall forming by drawing of the blank is started in cooperation by the upper drawing die and the lower drawing die;

successively, the pierced hole periphery portion of the blank is drawn in cooperation by the pierced hole periphery die and the lower drawing die by moving the pierced hole periphery die downward under pressure;

successively, the blank is pierced by the punch and the punch housing hole, successively, coining of the blank is started by the coining punch and the concave portion for coining; and as the upper die reaches the bottom dead center, the overall forming and coining of the blank are completed.

2. The press forming method for a sheet material according to claim 1, in which the upper die provided with the upper drawing die, the punch, and the trimming member also used as a blank holder and a bending die are lowered with respect to the lower die provided with the lower drawing die, a die, an outer periphery drawing die also used as a trimming member and a bending die, and a blank holder, wherein the outer periphery portion of a blank placed on the blank holder is held by the blank holder and the trimming member, successively, the central portion of the blank is drawn by the lower drawing die and the upper drawing die by moving the lower drawing die upward under pressure, successively, the outer periphery portion of the blank is trimmed by the trimming member and the outer periphery drawing die, successively, overall forming by drawing of the outer periphery portion of the blank performed by the upper drawing die and the outer periphery drawing die is started, and at the same time, piercing of the blank is performed by the punch and the die, and burring around an opened pierced hole is started, successively, bending of the outermost periphery portion of the blank is started by the trimming member and the outer periphery drawing die, and as the upper die reaches the bottom dead center, the overall forming, burring, and bending of the outermost periphery portion of the blank are completed.

3. The press forming method for a sheet material according to claim 1, in which the upper die provided with the upper drawing die, the punch, the blank holder, and the trimming member are lowered with respect to the lower die provided with the lower drawing die, a die, and an outer periphery drawing die also used as a blank holder and a trimming member, wherein the outer periphery portion of a blank placed on the outer periphery drawing die is held by the outer periphery drawing die and the blank holder, successively, the central portion of the blank is pressed between the upper drawing die and the lower drawing die, and the outer periphery portion of the blank is trimmed by the trimming member and the outer periphery drawing die, successively, drawing of the outer periphery portion of the blank is started by the upper drawing the and the outer periphery drawing die, successively, the blank is pierced by the punch and the die, and burring around an opened pierced hole is started, and as the upper die reaches the bottom dead center, the drawing of the outer periphery portion of the blank and the burring are completed.

4. The press forming method of claim 1, wherein the single cycle of pressing operation includes the drawing and a plurality of secondary working operations performed by the secondary working members.

5. A press forming apparatus for a sheet material comprising upper and lower dies wherein the upper die is lowered with respect to the lower die, in which the upper die is provided with one of a plurality of dies for drawing a sheet material and one of a plurality of synchronized secondary working members separate from the dies, which perform secondary working, which comprises at least one of trimming, piercing, burring, bending, or coining of the sheet material, and the lower die is provided with another of the plurality of dies and another of the secondary working members, and the sheet material is substantially formed by a single cycle of pressing operation;

wherein the upper die comprises:

an upper drawing die fixed to an upper die body;

a pierced hole periphery die having a concave portion for coining, which passes through the upper drawing die and is arranged in the upper die body so as to be movable in the vertical direction and can be moved downward under pressure;

a punch which passes through the pierced hole periphery die and is fixed to the upper die body; and an upper movable blank holder which is arranged at the outer periphery of the upper drawing die so as to be movable in the vertical direction and is urged downward with respect to the upper die body, the lower die comprises:

a lower drawing die which is arranged in a lower die body so as to be movable in the vertical direction and is urged upward with respect to the lower die body, and performs overall forming by drawing of the blank in cooperation with the upper drawing die and performs drawing of the periphery portion of the pierced hole of the blank in cooperation with the pierced hole periphery die;

a punch housing hole formed in the lower drawing die to pierce the blank in cooperation with the punch;

a coining punch which passes through the lower drawing die and is arranged in the lower die body so as to be movable in the vertical direction, and performs coining of the blank in cooperation with the concave portion for coining;

a lower movable blank holder which is arranged at the outer periphery of the lower drawing die so as to be movable in the vertical direction and is urged downward with respect to the lower die body, and holds the outer periphery portion of the blank in cooperation with the upper drawing die; and a trimming member, also used as a blank holder, which is arranged at the outer periphery of the lower movable blank holder and is fixed to the lower die body, and presses the outer periphery of the blank between the upper movable blank holder and the trimming member and also trims the outer periphery of the blank in cooperation with the upper drawing die, wherein the lower die body is provided further with a coining punch driving mechanism comprised of a trapezoidal horizontally movable member which is supported so as to be movable in the horizontal direction, a receiving member which has an inclined surface abutting on an inclined surface at one end of the horizontally movable member and is moved downward by receiving a pressing force due to the lowering of the upper die, and a vertically movable member which has an inclined surface abutting on an inclined surface at the other end of the horizontally movable member and is moved upward by receiving a pressing force due to the horizontal movement of the horizontally movable member.

6. The press forming apparatus for a sheet material according to claim 5, in which the upper die further comprises:

and a trimming member which is arranged at the outer periphery of the upper movable blank holder and is fixed to the upper die body, and is also used as a blank holder and a bending die, wherein the punch passes through the upper drawing die and is fixed to the upper die body; and the lower die further comprises:

a die which passes through the lower drawing die and is fixed to the lower die body, and performs piercing of the blank in cooperation with the punch and performs burring around an opened pierced hole;

wherein the lower drawing die is capable of applying pressure in the upward direction, and draws the central portion of a blank in cooperation with the upper drawing die;

wherein an outer periphery drawing die, also used as a trimming member and a bending die, which is arranged at the outer periphery of the lower drawing die and is fixed to the lower die body, performs overall forming by drawing of the outer periphery portion of the blank in cooperation with the upper drawing die, and trims the outer periphery portion of the blank in cooperation with the trimming member and further bends the outermost periphery portion of the blank in cooperation with the upper movable blank holder; and wherein the lower movable blank holder is urged upward with respect to the lower die body.

7. The press forming apparatus for a sheet material according to claim 5, in which the upper die further comprises:

a trimming member which is arranged at the outer periphery or the upper movable blank holder and is fixed to the upper die body, and the lower die further comprises:

a die which passes through the lower drawing die and is fixed to the lower die body, and performs piercing of the blank in cooperation with the punch and performs burring around an opened pierced hole; and an outer periphery drawing die, also used as a blank holder and a trimming member, which is arranged at the outer periphery of the lower drawing die and is fixed to the lower die body, holds the outer periphery portion of the blank between the movable blank holder and the outer periphery drawing die, and trims the outer periphery portion of the blank in cooperation with the trimming member and further draws the outermost periphery portion of the blank in cooperation with the upper drawing die;

wherein the lower drawing die presses the central portion of a blank between the upper drawing die and the lower drawing die.

8. The press forming apparatus for a sheet material according to claim 5, in which the upper die body is comprised of a top plate and a holder arranged under the top plate, the upper drawing die is fixed to the holder, the pierced hole periphery die is installed to a connecting body capable of applying pressure in the downward direction, which passes through the upper drawing die and the holder and is hung from the holder, the punch passes through the pierced hole periphery die and the holder and is fixed to the top plate, the upper movable blank holder passes through the holder and is fixed to the top plate, the holder is urged downward by a spring member installed to the top plate, and the lower surface thereof is supported by the lower end of a retainer which passes through the holder and is installed to the top plate, when the upper die is lowered, the lowering of the holder is stopped by the resistance force at the time of trimming of the outer periphery portion of the blank and only the top plate is lowered until a pressurizing tool provided on the lower surface of the top plate abuts on the holder, and subsequently, after the pressurizing tool has abutted on the holder, the whole of the upper die has lowered to the bottom dead center, and the forming of the blank has been completed, when the upper die is raised, the rising of the holder is prevented from occurring until the lower end of the retainer abuts on the lower surface of the holder.

9. The press forming apparatus of claim 5, wherein the sheet material is substantially formed by drawing and by a plurality of secondary working operations performed by the secondary working members.

* * * * *